US010842705B2

(12) United States Patent
Sampson et al.

(10) Patent No.: US 10,842,705 B2
(45) Date of Patent: Nov. 24, 2020

(54) SYSTEM AND METHODS FOR PROVIDING AND USING A KNEE RANGE OF MOTION DEVICE

(71) Applicant: DYNATRONICS CORPORATION, Salt Lake City, UT (US)

(72) Inventors: Douglas Sampson, Salt Lake City, UT (US); John William Dyke, Stansbury Park, UT (US); Scott Russell Mabey, West Bountiful, UT (US); Mosiah Troy Smalley, Kaysville, UT (US); Christopher Edwin Spencer, Riverton, UT (US)

(73) Assignee: Dynatronics Corporation, Salt Lake City, UT (US)

( * ) Notice: Subject to any disclaimer, the term of this patent is extended or adjusted under 35 U.S.C. 154(b) by 376 days.

(21) Appl. No.: 15/788,409

(22) Filed: Oct. 19, 2017

(65) Prior Publication Data

US 2018/0104130 A1 Apr. 19, 2018

Related U.S. Application Data

(60) Provisional application No. 62/410,183, filed on Oct. 19, 2016.

(51) Int. Cl.
*A61H 1/02* (2006.01)

(52) U.S. Cl.
CPC ..... *A61H 1/024* (2013.01); *A61H 1/0244* (2013.01); *A61H 1/0266* (2013.01); (Continued)

(58) Field of Classification Search
CPC ..... A61H 1/024; A61H 2201/5069; A61H 2201/501; A61H 2201/5066; (Continued)

(56) References Cited

U.S. PATENT DOCUMENTS 4,691,694 A 9/1987 Boyd et al.
4,765,315 A 8/1988 Krukowski
(Continued)

FOREIGN PATENT DOCUMENTS

EP 2732801 A1 5/2014
WO 2008120137 A1 10/2008

*Primary Examiner* — Kendra D Carter
*Assistant Examiner* — Arielle Wolff
(74) *Attorney, Agent, or Firm* — David B. Tingey; Bryant J. Keller; Kirton McConkie

(57) ABSTRACT

The described knee rehabilitation device can include any suitable component. In some implementations, however, it includes a sitting surface that is configured to support a user; a knee arm that comprises a leg coupling mechanism, that is pivotally coupled to the rehabilitation device, and that is configured to pivot through a range of motion; and a drive mechanism that is configured to force the knee arm through the range of motion. In some cases, the drive mechanism includes a first hard stop that prevents the knee arm from extending past a first set point, and the drive mechanism further includes a second hard stop that prevents the knee arm from being retracted past a second set point. In some cases, the device is further configured to be programmed to electronically limit the knee arm's range of motion. Other implementations are discussed.

15 Claims, 18 Drawing Sheets

(52) U.S. Cl.
CPC ..... *A61H 1/0277* (2013.01); *A61H 1/0281* (2013.01); *A61H 1/0285* (2013.01); *A61H 1/0288* (2013.01); *A61H 2201/1215* (2013.01); *A61H 2201/1642* (2013.01); *A61H 2201/1671* (2013.01); *A61H 2201/1676* (2013.01); *A61H 2201/501* (2013.01); *A61H 2201/5007* (2013.01); *A61H 2201/5012* (2013.01); *A61H 2201/5064* (2013.01); *A61H 2201/5066* (2013.01); *A61H 2201/5069* (2013.01); *A61H 2205/102* (2013.01)

(58) Field of Classification Search
CPC ..... A61H 2201/1676; A61H 1/0266; A61H 2201/5012; A61H 2201/5007; A61H 2201/1671; A61H 2205/102; A61H 2201/1642; A61H 2201/1215; A61H 2201/5064; A61H 1/0281; A61H 1/0288; A61H 1/0285; A61H 1/0244; A61H 1/0277; A61H 1/00; A61H 3/00; A61H 2001/0203; A61H 2001/0207; A61H 1/0237; A61H 1/0255; A61H 1/0259; A61H 1/0274; A61H 2203/0425; A61H 2203/0431; A61H 2205/06; A61H 2205/062; A61H 2205/10; A61H 2205/106; A61H 2205/108; A61H 2201/0149
See application file for complete search history.

(56) References Cited

U.S. PATENT DOCUMENTS

| | | | | |
|---|---|---|---|---|
| 5,020,794 | A | 6/1991 | Englehardt et al. | |
| 5,040,522 | A | 8/1991 | Daniels | |
| 5,054,774 | A | 10/1991 | Belsito | |
| 5,209,223 | A | 5/1993 | McGorry et al. | |
| 5,388,143 | A | 2/1995 | MacMahon | |
| 5,509,894 | A | 4/1996 | Mason et al. | |
| 6,962,570 | B2 | 11/2005 | Callanan et al. | |
| 7,534,213 | B2 | 5/2009 | Shelbourne et al. | |
| 7,695,416 | B2 | 4/2010 | Weiner | |
| 8,409,121 | B1 | 4/2013 | Al-Oboudi | |
| 2002/0183655 | A1* | 12/2002 | Zhang | A61H 1/02 600/587 |
| 2003/0171196 | A1 | 9/2003 | Cunningham | |
| 2004/0256899 | A1 | 12/2004 | Moore et al. | |
| 2006/0126796 | A1 | 6/2006 | Hecker | |
| 2009/0093353 | A1 | 4/2009 | Weiner | |
| 2009/0163837 | A1 | 6/2009 | Sanger et al. | |
| 2013/0079683 | A1 | 3/2013 | Ewing | |
| 2013/0261511 | A1 | 10/2013 | Smith et al. | |
| 2014/0039360 | A1 | 2/2014 | Spade | |
| 2014/0316317 | A1 | 10/2014 | Nace et al. | |
| 2015/0057137 | A1 | 2/2015 | Chen | |
| 2015/0072835 | A1 | 3/2015 | Kunstmann | |
| 2015/0352394 | A1* | 12/2015 | Marti | A63B 71/0622 482/139 |

* cited by examiner

SYSTEM AND METHODS FOR PROVIDING AND USING A KNEE RANGE OF MOTION DEVICE

CROSS-REFERENCE TO RELATED APPLICATION

This non-provisional application claims priority to U.S. Provisional Patent Application Ser. No. 62/410,183, filed Oct. 19, 2016 and entitled "SYSTEMS AND METHODS FOR PROVIDING AND USING A KNEE RANGE OF MOTION DEVICE," the entire disclosure of which is hereby incorporated by reference.

BACKGROUND OF THE INVENTION

1. Field of the Invention

The present invention relates to systems and methods for providing a knee range of motion device. In some implementations, the described device includes a knee arm that is configured to pivot through a range of motion and a drive mechanism that is configured to force the knee arm through the range of motion. In some cases, the drive mechanism includes a first hard stop that prevents the knee arm from extending past a first set point, and the drive mechanism further includes a second hard stop that prevents the knee arm from being retracted past a second set point. In some cases, the device is further configured to be programmed to electronically limit and/or adjust the knee arm's range of motion.

2. Background and Related Art

Often times, after a knee or leg has been operated on, damaged, or otherwise injured, the knee can become stiff and the knee's range of motion can become limited. In some cases, if such a knee is not rehabilitated, scar tissue can form and the knee's range of motion can be permanently limited. In some instances, where the knee's range of motion is limited, not only can use of the knee be relatively painful, but the knee's limitations can result in a loss of mobility and in future back, hip, knee, and leg pain.

Many physical therapy devices have been developed to help a user extend and retract (or flex) his or her knee to rehabilitate the knee and to increase the knee's range of motion. While many such devices may be useful at helping to increase a knee's range of motion, such devices are not necessarily without their shortcomings. Indeed, some conventional physical therapy devices are relatively dangerous to use—exposing their users to a significantly high risk of injury. Additionally, some conventional physical therapy devices can be complicated to use and difficult to tailor to a specific user's needs and desires.

Thus, while techniques currently exist that are used to rehabilitate knees, challenges still exist, including those discussed above. Accordingly, it would be an improvement in the art to augment or even replace current techniques with other techniques.

SUMMARY OF THE INVENTION

The present invention relates to systems and methods for providing a knee range of motion device. In some implementations, the described device includes a knee arm that is configured to pivot through a range of motion and a drive mechanism that is configured to force the knee arm through the range of motion. In some cases, the drive mechanism includes a first hard stop that prevents the knee arm from extending past a first set point, and the drive mechanism further includes a second hard stop that prevents the knee arm from being retracted past a second set point. In some cases, the device is further configured to be programmed to electronically limit and/or adjust the knee arm's range of motion. In some cases, the device further comprises a remote stop that is configured to allow a user to immediately stop the knee arm from moving through the range of motion.

While the systems and methods described herein can be particularly useful in the area of knee rehabilitation, those skilled in the art can appreciate that the described methods and processes can be used in a variety of different applications and in a variety of different areas of manufacture to aid in joint rehabilitation. By way of non-limiting example, some implementations of the described systems and methods (and portions thereof) can be used (or modified for use) for elbow, hip, wrist, ankle, back, finger, and/or shoulder range of motion devices.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Figure 1:
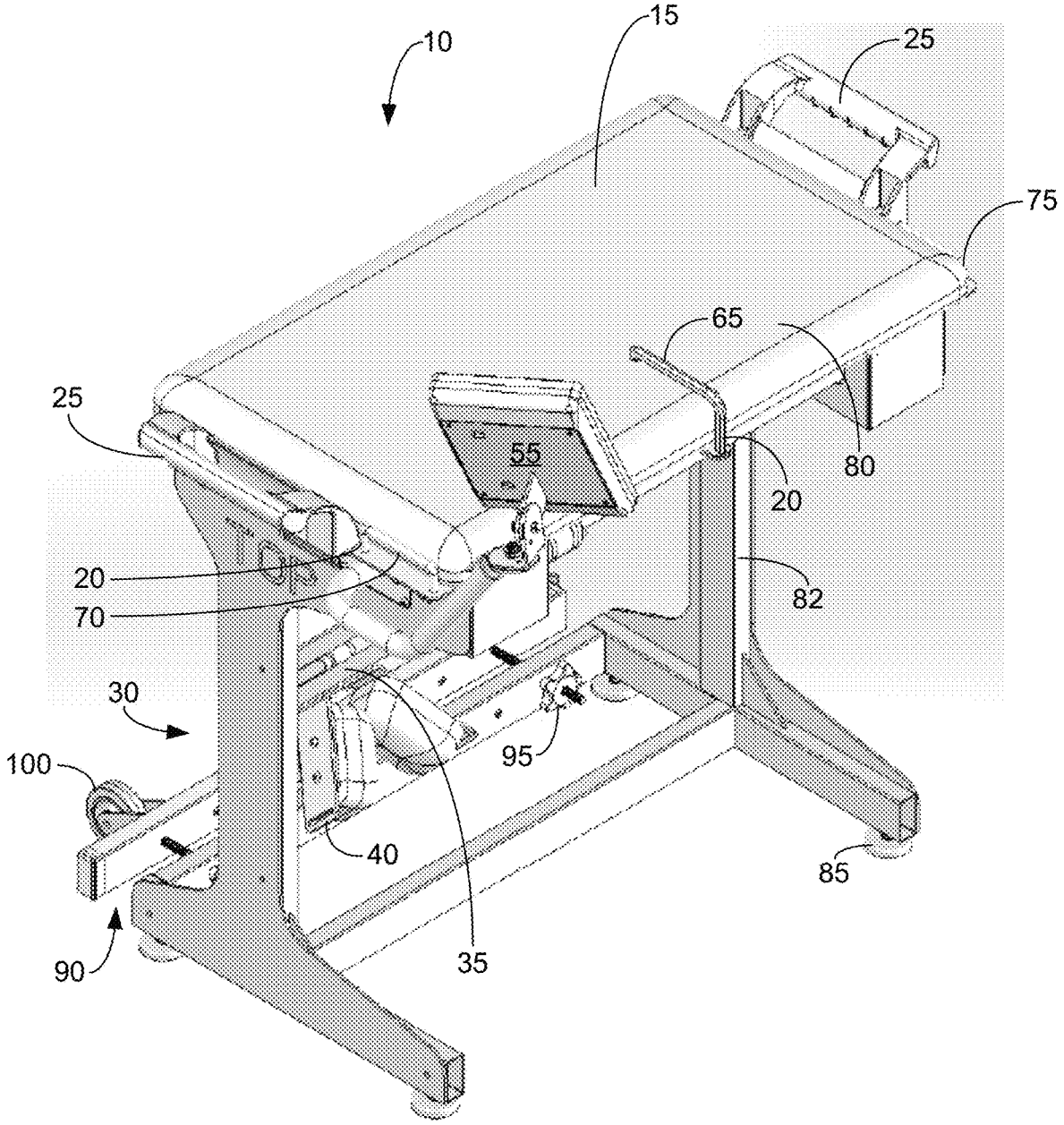
FIG. 1 illustrates a front side perspective view of a knee range of motion device in accordance with a representative embodiment.

Reference throughout this specification to "one embodiment," "an embodiment," "an implementation," and similar language means that a particular feature, structure, or characteristic described in connection with the embodiment or implementation is included in at least one embodiment of the present invention. Thus, appearances of the phrases "in one embodiment," "in an embodiment," "in another embodiment," "in some implementations," "in some other embodiments," "in some other implementations," and similar language throughout this specification may, but do not necessarily, all refer to the same embodiment or implementation.

Furthermore, the described features, structures, or characteristics of the described systems and methods may be combined in any suitable manner in one or more embodiments. In the following description, numerous specific details are provided, such as examples of suitable support surfaces, support structures, knee arms, leg coupling mechanisms, drive mechanisms, user support surfaces, computer devices, computer systems, etc., to provide a thorough understanding of embodiments of the invention. One having ordinary skill in the relevant art will recognize, however, that the described systems and methods may be practiced without one or more of the specific details, or with other systems, methods, techniques, components, materials, and so forth. In other instances, well-known systems, structures, materials, methods, or operations are not shown or described in detail to avoid obscuring aspects of the invention.

The following disclosure of the described systems and methods is grouped into two subheadings, namely "Representative Systems and Methods" and "Representative Operating Environment." Utilization of the subheadings is for convenience of the reader only and is not to be construed as limiting in any sense.

Representative Systems and Methods

The present invention relates to systems and methods for providing a knee range of motion device. In some embodiments, the device is configured to move a knee through a range of motion to stretch muscles and/or ligaments associated with the knee, to prevent scaring in the knee, and/or to otherwise provide physical therapy to the knee. In some embodiments, the described device includes a knee arm that is configured to pivot through a range of motion and a drive mechanism that is configured to force the knee arm through the range of motion. In some embodiments, the drive mechanism includes a first hard stop that prevents the knee arm from extending past a first set point, and the drive mechanism further includes a second hard stop that prevents the knee arm from being retracted past a second set point. In some embodiments, the device is further configured to be programmed to electronically limit and/or adjust the knee arm's range of motion. Additionally, in some embodiments, the device further comprises a remote stop that is configured to allow a user to immediately stop the knee arm from moving through the range of motion.

While the described knee range of motion device can comprise any suitable component or characteristic that allows it to function as intended (and as described above), FIGS. 1-2 show some embodiments in which the knee range of motion device 10 comprises one or more user support surfaces 15, user securing mechanisms 20, handles 25, support structures 30, knee arms 35, leg coupling mechanisms 40, drive mechanisms 45, processing systems 50, and/or user interfaces 55.

With respect to the user support surface 15, the support surface can comprise any suitable component that allows it to support a user while the device 10 moves the user's leg through a range of motion. In some embodiments, the support surface comprises at least a portion of a seat, a bench, a chair, a table top, and/or any other suitable sitting surface; a bed; a desk; a backrest; a head rest; one or more armrests; and/or any other suitable object that is capable of supporting a user during use of the device. In some embodiments, however, the support surface comprises a sitting surface, such as a cushioned or non-cushioned seat.

Turning now to the user securing mechanisms 20, some embodiments of the knee device 10 comprise one or more mechanisms for securing a thigh, waist, torso, and/or other portion of a user to the support surface 15 (and/or another suitable portion of the device) as the user uses the device. Indeed, in some cases, the user securing mechanism is configured to hold one or more of the user's thigh in place when the user is being treated by the device 10.

Figure 2:
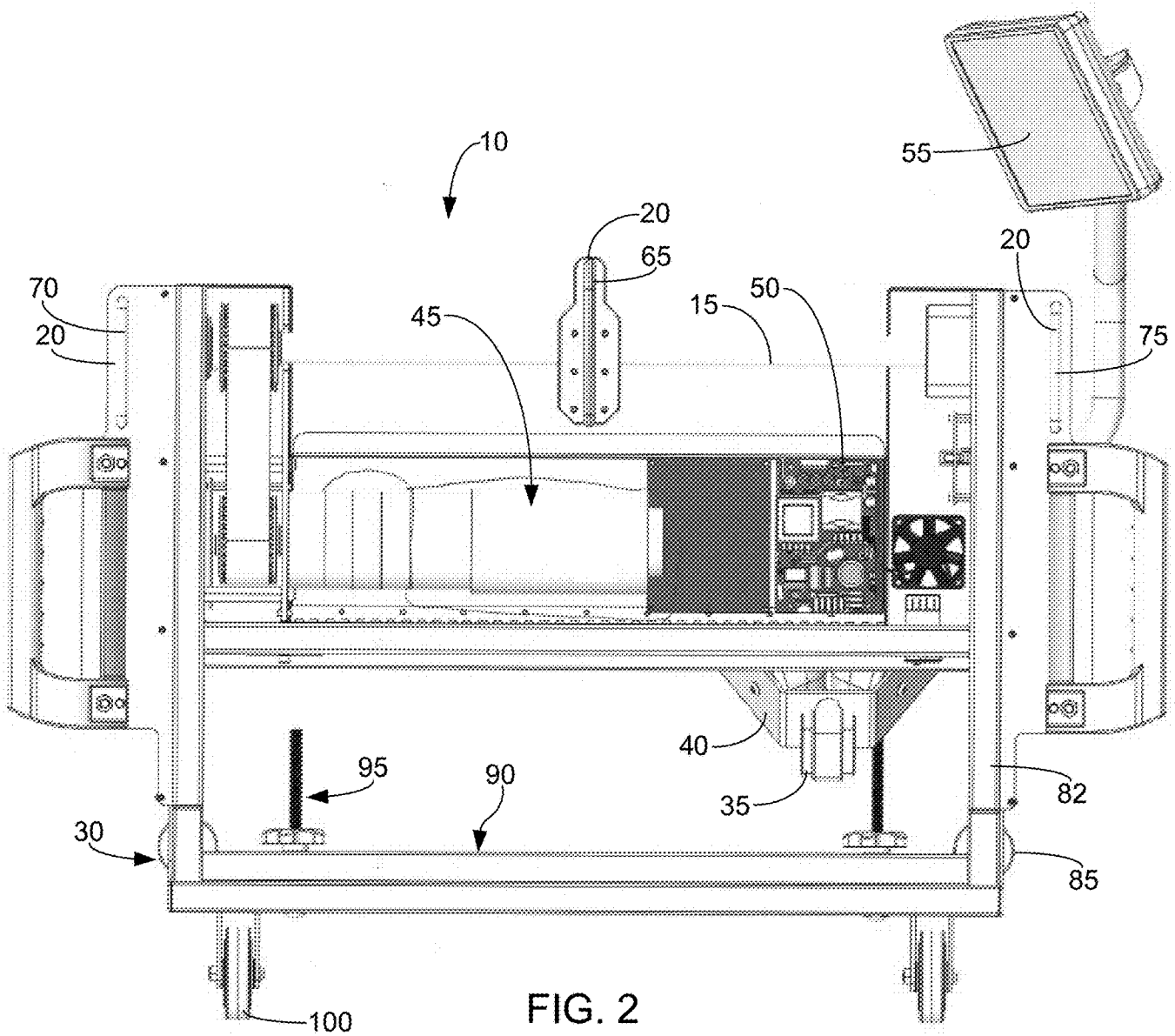
FIG. 2 illustrates a top plan view of the knee range of motion device, with a user support surface removed, in accordance with a representative embodiment.
Figure 3:
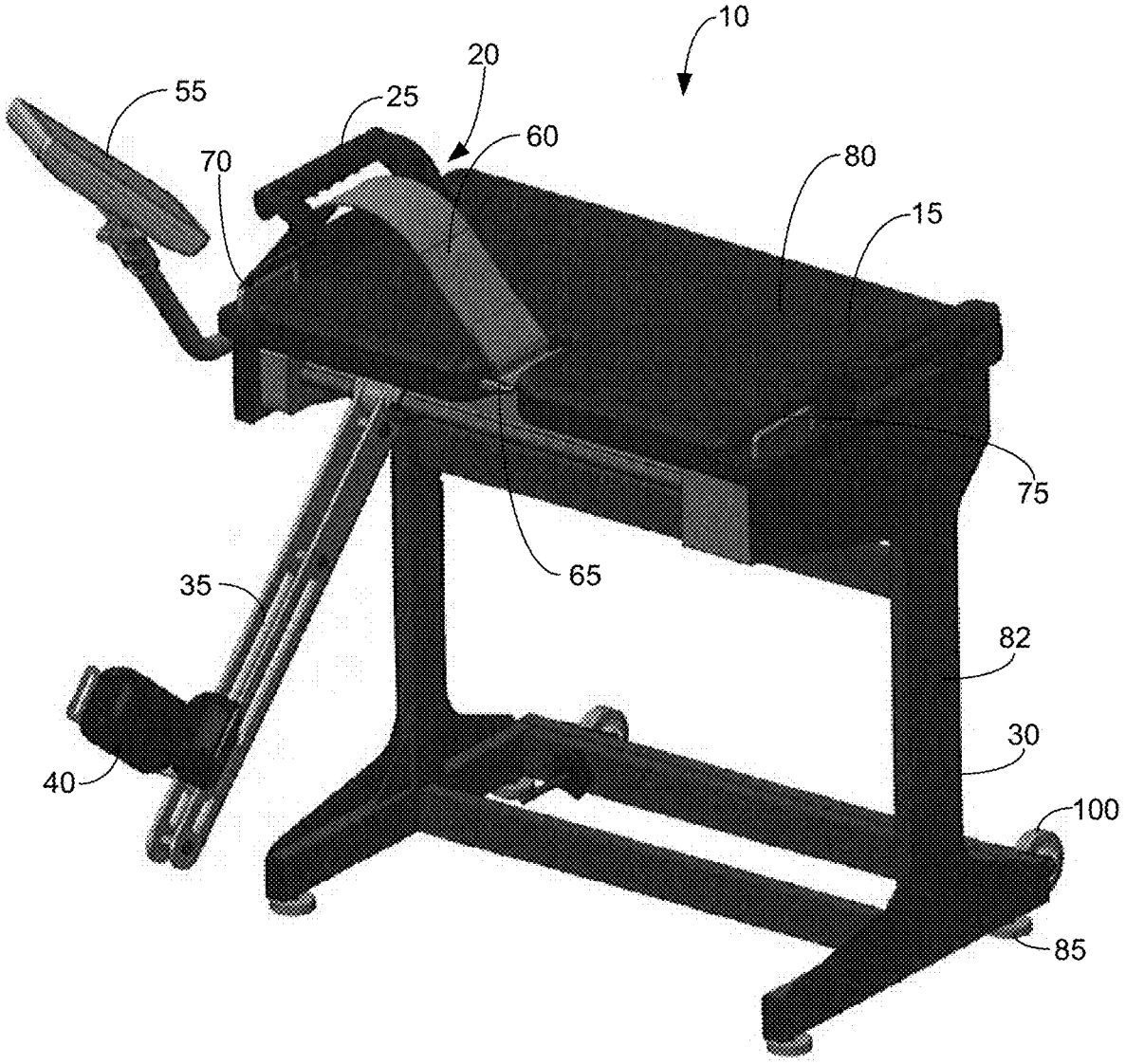
FIG. 3 illustrates a perspective view of the knee range of motion device in accordance with a representative embodiment.
Figure 4:
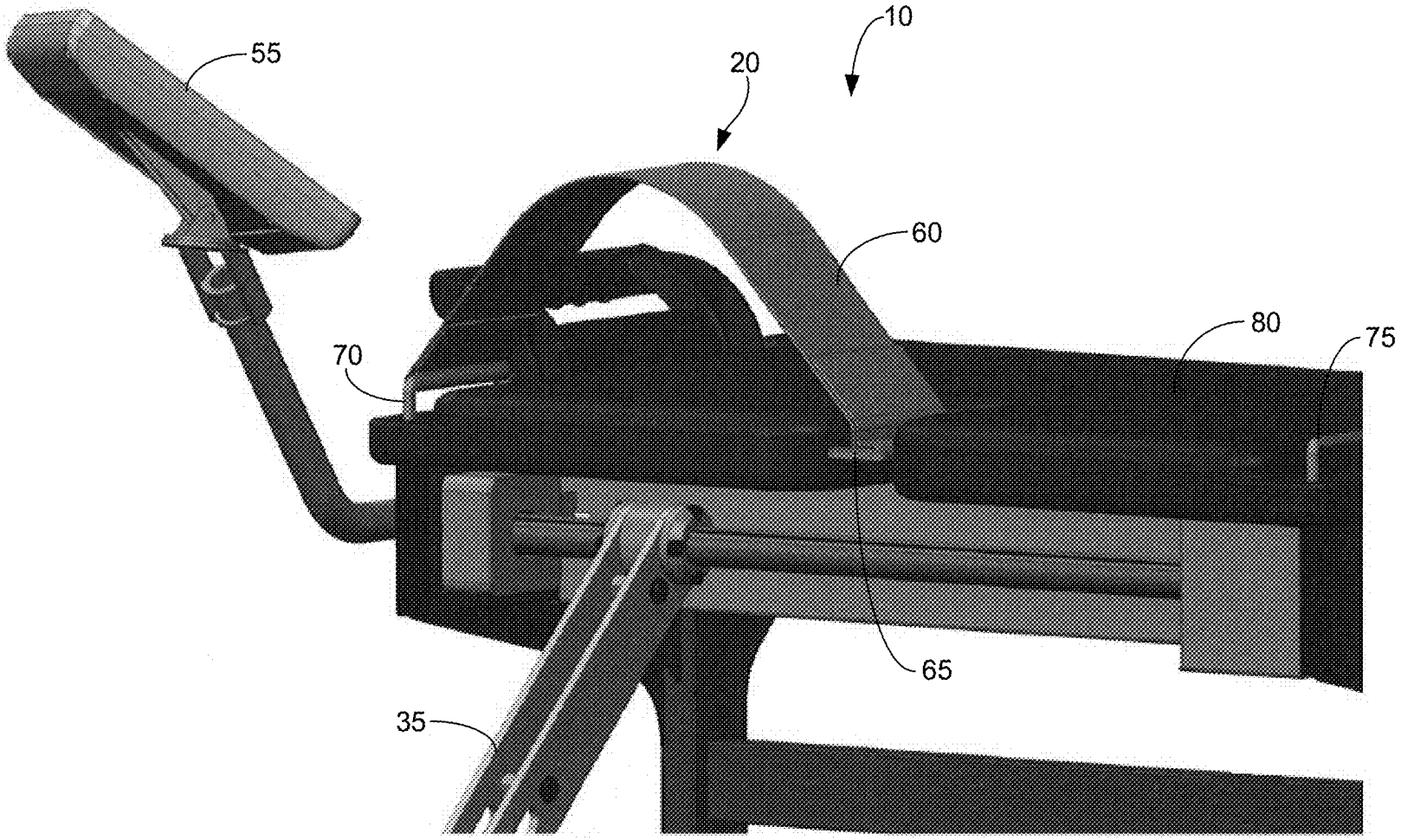
FIG. 4 illustrates a perspective view of a portion of the knee range of motion device showing a user securing mechanism in accordance with a representative embodiment.

While the user securing mechanism 20 can comprise any suitable component that allows it to function as described herein, some non-limiting examples of such securing mechanisms include one or more straps, belts, clamps, supports, ties, restraints, braces, and/or any other suitable mechanisms that are capable of holding a user (e.g., a user's thigh and/or any other suitable portion of the user) in place as the user uses the device. In some embodiments, however, the securing mechanism comprises one or more straps (e.g., straps comprising one or more hook-and-loop fasteners, buckles, snaps, closures, closing mechanisms, D-rings, loops, clamps, eyelets, and/or other mechanisms for selectively maintaining the straps in a desired position and for selectively releasing the straps from such position).

Where the securing mechanism 20 is configured to releasably secure a user's thigh to the knee device 10, the securing mechanism can function in any suitable manner. Indeed, in some embodiments, a strap of the securing mechanism is configured to extend under and/or to loop around the user's thigh. In some other embodiments, however, the securing mechanism is configured to simply extend over a thigh of a user (and to thus be relatively safe and easy to use). While the securing mechanism can be configured to extend over a thigh of a user in any suitable manner, FIGS. 3-4 show some embodiments in which the securing mechanism 20 comprises a strap 60 (e.g., a non-adjustable and/or adjustable strap) that is configured to couple (e.g., via stitching, hook and loop fasteners, buckles, snaps, and/or in any other suitable manner) to a first 65 and a second 70 anchor to strap a first (e.g., a right) thigh into the device 10. Additionally, FIGS. 3-4 show that, in some embodiments, the device 10 also comprises a third anchor 75 to allow the strap 60 to extend between the first anchor 65 and the third anchor 75 to strap a second (e.g., a left) thigh in the device 10.

Where the knee device 10 comprises one or more anchors (e.g., 65, 70, and/or 75), the anchors can be disposed in any suitable location on the device and in any suitable relation to a top of the support surface 15. In this regard, while FIG. 1 shows an embodiment in which the first anchor 65 is raised above a top 80 of the user support surface 15, FIGS. 3-4 show some other embodiments in which the first anchor 65 is disposed below the top 80 of the support surface 15 to prevent the user's thighs from undesirably contacting the first anchor (e.g., and becoming bruised or otherwise hurt).

Figure 16:
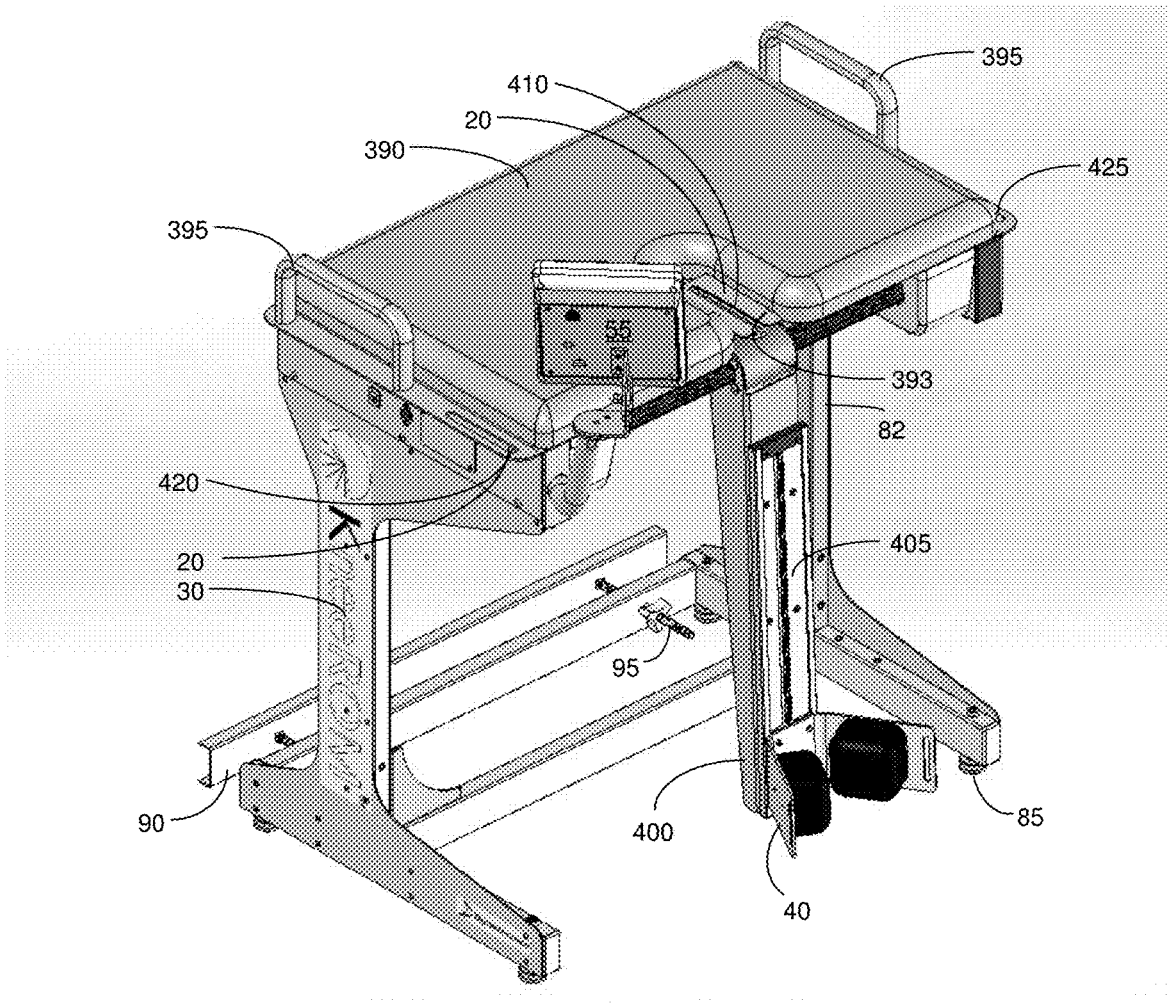
FIG. 16 illustrates a front side perspective view of the knee range of motion device in accordance with a representative embodiment.

With respect now to the handles 25, some embodiments of the knee device 10 comprise one or more handles. While the handles can perform any suitable function, in some embodiments, the handles are configured to help a user to get on and/or off the device; to help the user keep his or her balance while being disposed on the support surface 15; and/or to otherwise make using the device more convenient.

Where the knee device 10 comprises one or more handles 25, the handles can be disposed in any suitable location on the device, including, without limitation, at one or more sides of the support surface 15, at a back of the support surface, being: formed in the support surface, in front of and/or to the side of the support surface, above and/or below the support surface, attached to one or more portions of the support structure 30, and/or in any other suitable location. Indeed, as shown in FIGS. 3-4 and 16, in some embodiments, the device 10 comprises a handle 25 (or 395) on either or both lateral sides of the support surface 15 (or 390) (and being placed somewhat closer to a back side of the support surface than to a front side (e.g., so as to be comfortable during use)).

With reference now to the support structures 30, the support structure can comprise any suitable object that is capable to supporting a user on the support surface 15 while the user uses the device. In some embodiments, the supporting structure comprises a stand, frame, framework, chassis, scaffold, furniture piece, cabinet, and/or other structure that is configured to support the support surface 15 and a user disposed thereon. Indeed, as shown in FIG. 3, some embodiments of the support structure 30 comprise a frame 82.

Figure 5:
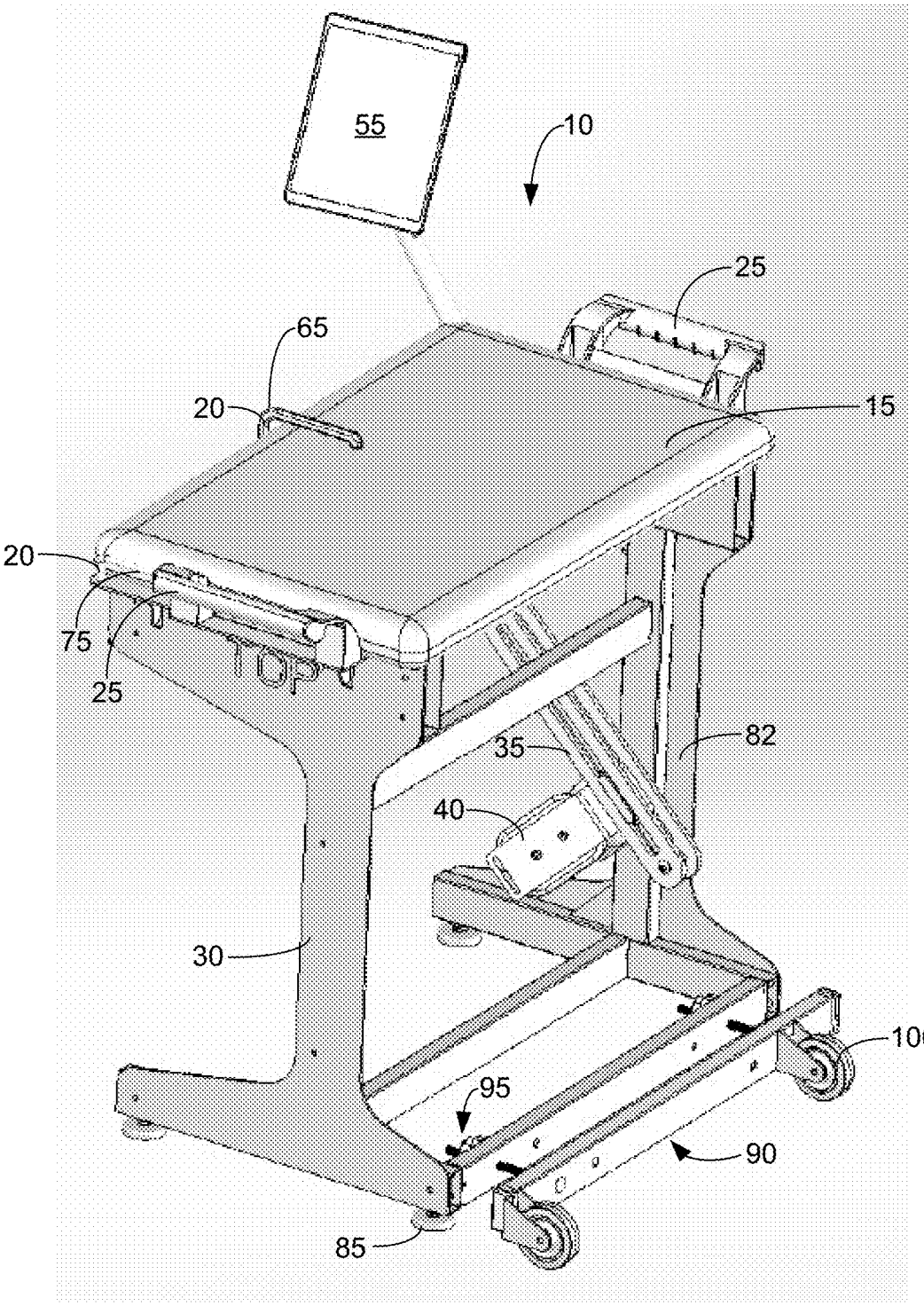
FIG. 5 illustrates a back side perspective view of the knee range of motion device in accordance with a representative embodiment.

While the support structure 30 can have any suitable characteristic, in some embodiments, a height of the support structure is configured to be adjusted to raise and/or lower the support surface 15. In this regard, the height of the support surface may be adjusted for any suitable reason, including, without limitation, to help a user to get onto and off the device, to match the height of the support surface with the height of another object (e.g., a bed, table, and/or any other suitable object), and/or for any other suitable purpose. Indeed, in some embodiments, the support structure is adjustable such that the support surface can be raised and/or lowered to substantially match the height of a bed or other patient support.

Where the height of the support structure 30 (and hence the support surface 15) is adjustable, the support structure's height can be adjusted in any suitable manner, including, without limitation, by being adjustable manually, automatically, and/or in any other suitable manner. By way of non-limiting example, some embodiments of the support structure are configured to be adjusted in height via the adjustment of one or more threaded members, manual cranks, motors, hydraulic actuators, pneumatic actuators, servos, linear actuator, actuators, gears, belt drives, chain drives, pistons, and/or other suitable mechanisms for adjusting the support structure's height. For instance, FIGS. 3 and 5 show some embodiments in which the knee device 10 comprises one or more height adjustable feet 85 that can be twisted or otherwise adjusted to raise and/or lower a height of the support structure 30 and the support surface 15. In some other embodiments, the frame comprises one or more pistons, threaded, members, and/or other suitable components that are configured to automatically raise and/or lower the support structure.

Figure 6:
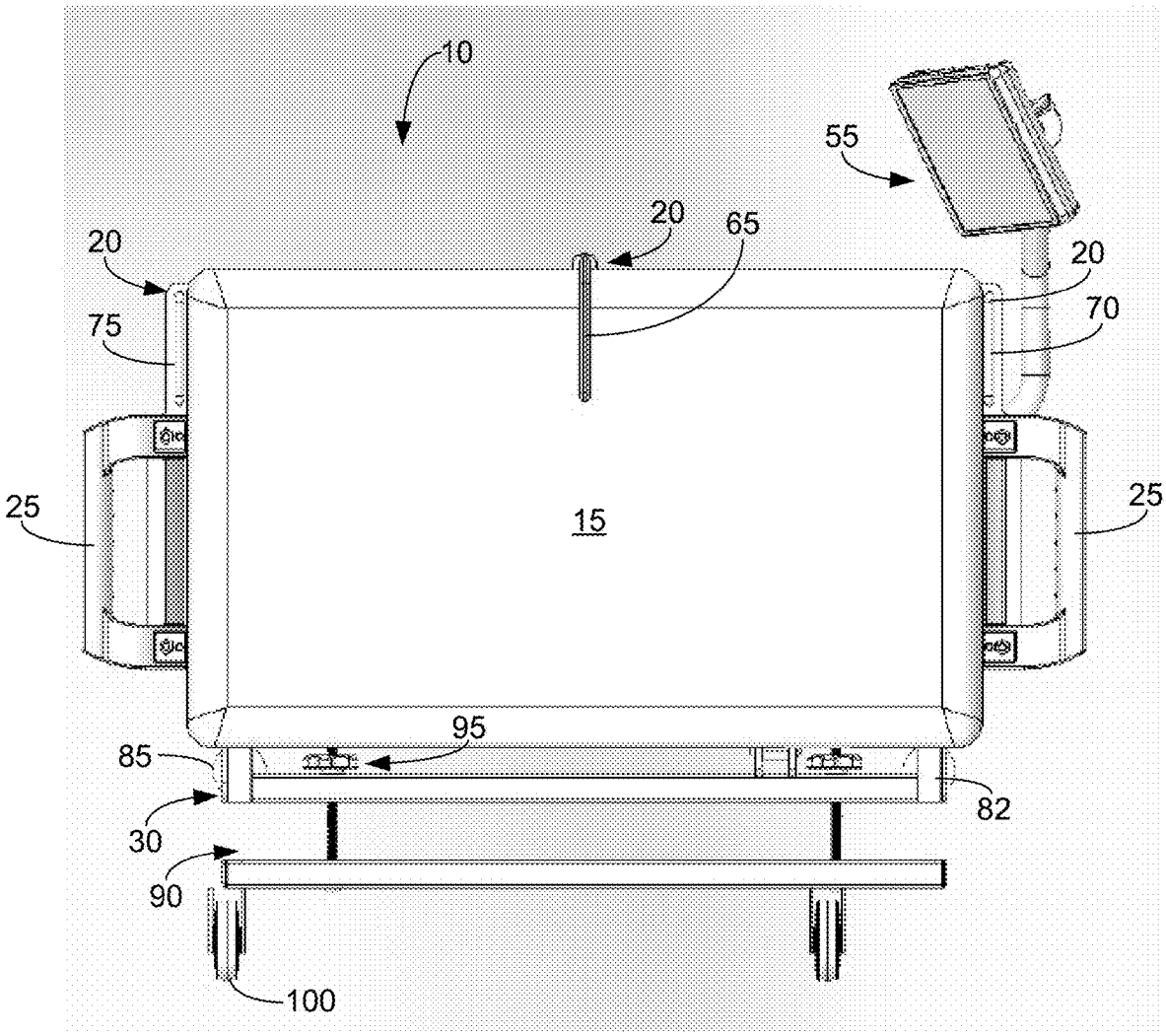
FIG. 6 illustrates a top plan view of the knee range of motion device in accordance with a representative embodiment.

In some embodiments, the support structure 30 is optionally configured to be coupled to one or more other objects, which may include, without limitation, one or more beds, tables, carts, chairs, and/or other suitable patient supports. In some such embodiments, the support structure can couple to another object in any suitable manner, including, without limitation, via one or more mechanical fasteners, frictional engagements, clamps, catches, mating couplers, magnets, slots and grooves, couplers, quick-release connectors, connectors, straps, ties, and/or any other suitable coupling mechanisms. By way of non-limiting illustration, FIGS. 5 and 6 show some embodiments in which the support structure 30 is configured to couple to another object (not shown) via a clamping mechanism 90 that can be actuated in any suitable manner, including, without limitation, by tightening and/or loosening one or more threaded couplers 95 and/or or other suitable mechanisms.

In some embodiments, the support structure 30 is configured to be readily movable. While the support structure can be configured to be movable in any suitable manner, in some embodiments, the support structure comprises one or more wheels 100 (e.g., as shown in FIGS. 5 and 6). Additionally, where the support structure comprises one or more wheels, the wheels can be configured to facilitate movement of the support structure when the support structure is in any suitable orientation. For instance, FIGS. 5 and 6 show some embodiments in which the wheels 100 are configured to make it relatively easy to wheel the device 10 around when the device is leaned back onto the wheels, while preventing the device from rolling when the device is in oriented to support a user using the device (e.g., when the device is on one or more (e.g., four) adjustable feet 85).

Figure 7:
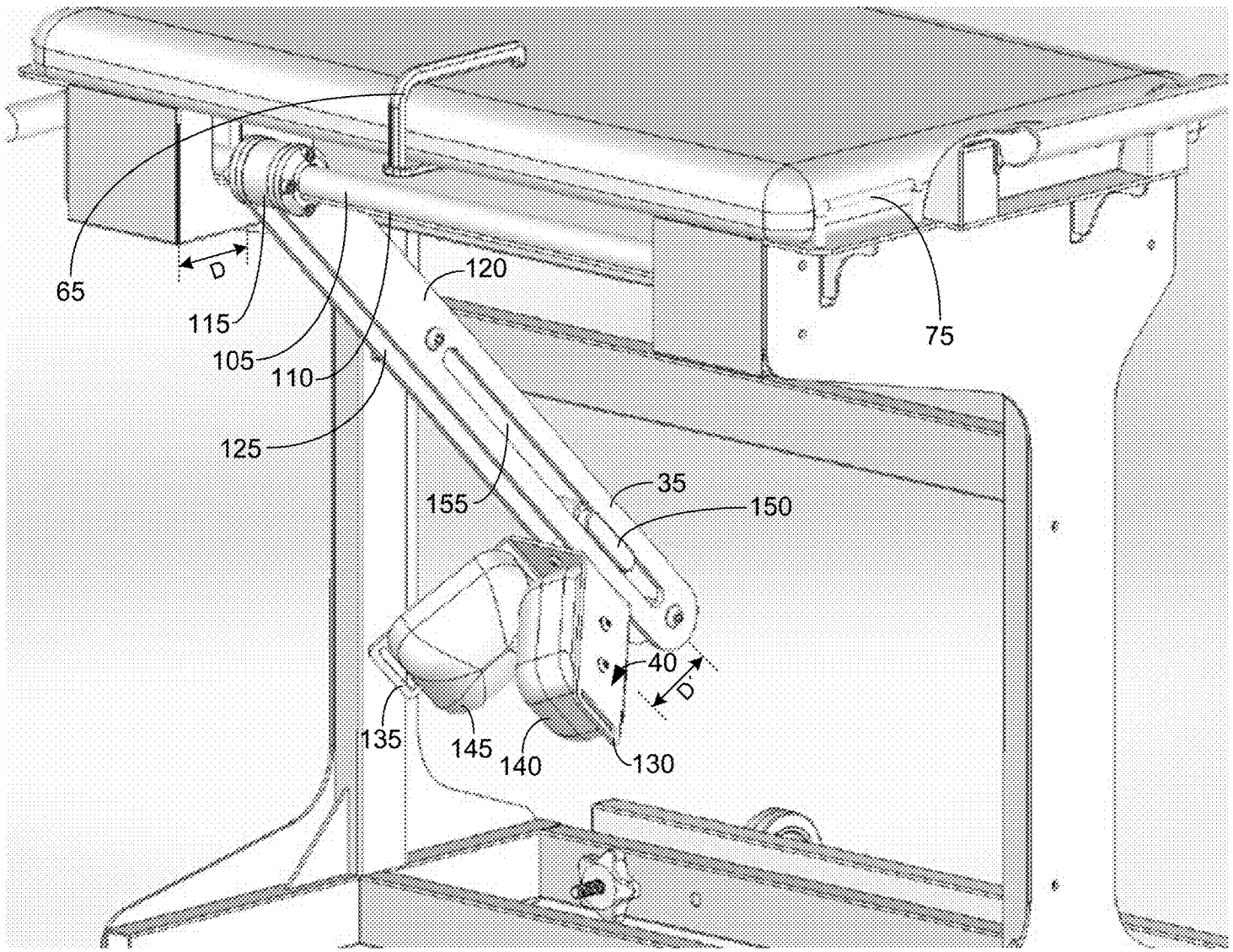
FIG. 7 illustrates a perspective view of a portion of the knee range motion device comprising a knee arm and a leg coupling mechanism in accordance with a representative embodiment.

Turning now to the knee arm 35, the knee arm can comprise any suitable component or characteristic that allows it to be coupled to a user's leg so as to force and/or otherwise move with the leg through a range of motion. While some embodiments of the knee device 10 comprise two or more knee arms 35 (e.g., for providing therapy to two legs simultaneously), some other embodiments comprise a single knee arm (e.g., as illustrated in FIGS. 1-6). In some embodiments in which the knee device comprises a single knee arm, the knee arm is fixed in a single position (e.g., from left to right and vice versa) so as to be rotatable through a single plane (e.g., to move a left leg when disposed at a left side of the device, to move a right leg when disposed at a right side of the device, or to move the right and/or left legs when disposed towards a center of the device). In some other embodiments, however, the knee arm is configured to be moved laterally from one side of the knee device, to a center of the device (e.g., for use with both legs simultaneously), and/or to another side of the device (e.g., to be usable for each leg individually).

Where the knee arm 35 is movable on the knee device 10, the knee arm can couple to the knee device in any suitable manner. Indeed, in some embodiments, the knee arm is slidably, releasably, and/or otherwise movably coupled to a rotatable shaft, such that a position of the knee arm can be moved along a length of the shaft, while rotation of the knee arm is enslaved to the rotation of the shaft. In some embodiments, one or more portions of the shaft are not perfectly cylindrical (e.g., the shaft comprises one or more ridges, grooves, flat spots, protrusions, recesses, cam portions, and/or other features) and a coupler that connects the knee arm to the shaft is keyed to the shaft so as to enslave rotation of the knee arm with rotation of the shaft. By way of non-limiting illustration, FIG. 7 shows an embodiment in which a rotatable shaft 105 comprises one or more grooves 110 and in which the knee arm coupler 115 comprises one or more internal protrusions (not shown), which slidably mate with the grooves so as to allow the knee arm coupler to slide on the shaft while transferring torque from the shaft to the knee arm.

Although, in some embodiments, the knee arm 35 is configured to selectively be retained in and to be selectively releasable from one or more positions along the length of the shaft 105 (e.g., via one or more detent mechanisms, ratchet mechanisms, magnetic couplers, clamping mechanisms, pawls, and/or other suitable mechanisms that are configured to perform such a function), in some embodiments, the knee arm is configured to freely slide along a length of the shaft (e.g., via the knee arm coupler 115). Accordingly, in some such embodiments, the knee arm is configured to slide somewhat from side to side throughout its range of motion to accommodate variations in the range of motion of a user's leg as the user uses the device 10.

The knee arm 35 can comprise any suitable components that allow it to function as intended. Some embodiments of the knee arm, however, comprise one or more elongated elements that are configured to be rotationally enslaved with the rotation of the shaft 105 and to be coupled with one or more leg coupling mechanisms 40 (discussed below). By way of non-limiting illustration, FIG. 7 shows an embodiment in which the knee arm 35 comprises a first 120 and a second 125 elongated member that couple with the leg coupling mechanism 40.

The rotational axis of the knee arm 35 (i.e., the rotatable shaft 105) can be disposed in any suitable location on the knee device 10 that allows the device to function as intended. Indeed, while, in some embodiments, the shaft is located at a front end of the device, in some other embodiments, the shaft is disposed behind the front end of the device and beneath a portion of the support surface 15. In such latter embodiments, the shaft can be located in any suitable location. In some such embodiments, however, a rotational axis of the shaft is located behind the front end of the device by a distance (e.g., distance D shown in FIG. 7) that is substantially equal to a distance between a posterior portion of a user's leg coupled to the knee arm and a central axis of the knee arm (e.g., distance D' shown in FIG. 7). Accordingly, in some such embodiments, a portion of a user's leg may remain substantially parallel to the knee arm as the leg and knee arm move through the knee arm's range of motion. Additionally, although in some embodiments, the position of the rotational axis of the shaft (and/or knee arm) is configured to be fixed in place with respect to a front end of the user support surface 15, in some embodiments, the user support surface and/or the rotational axis of the shaft and/or knee arm are configured to be selectively movable (e.g., via one or more gears, rails, sliders, servos, actuators, motors, cranks, and/or other suitable adjustment mechanisms) and lockable in position (e.g., via one or more clamps, locking mechanisms, ratcheting mechanisms, pawls, and/or other suitable locking mechanisms).

Turning now to the leg coupling mechanism 40, some embodiments of the knee arm 35 comprise one or more leg coupling mechanisms that are configured to be coupled to one or both of a user's legs and to keep the legs coupled to the knee arm throughout a range of motion of the knee arm. In this regard, the leg coupling mechanism can comprise any suitable component or characteristic that allows it to perform its intended functions. In one example, the leg coupling mechanism comprises one or more straps, belts, catches, and/or other couplers that are configured to selectively and releasably couple a user's ankle, calf, and/or other portion of a user's leg to the knee arm. By way of non-limiting illustration, FIG. 7 shows that, in some embodiments, one or more straps (not shown) can releasably and adjustably extend between a first 130 and a second 135 connection point to capture the user's leg (not shown).

As another example of a suitable component of the leg coupling mechanism 40, some embodiments of the leg coupling mechanism comprise one or more pieces of padding configured to pad and/or to otherwise protect a user's leg during therapy. In such embodiments, the padding and/or other suitable contact surface can have any suitable configuration. Indeed, in some embodiments, a piece of padding is configured to extend around a portion of a user's leg (e.g., calf, ankle, shin, etc.). In accordance with some other embodiments, however, FIG. 7 shows that the leg coupling mechanism 40 comprises a first 140 and a second 145 pad and/or contact surface that are separated by a space that allows a user's ankle and/or leg to be cushioned by the pads while the user's Achilles tendon (and/or another suitable portion of the user's leg and/or foot) is able to be disposed between the pads to reduce pressure on the tendon.

As another example of a suitable characteristic of the leg coupling mechanism 40, although some embodiments of the leg coupling mechanism are fixed or selectively fixed in location with respect to the knee arm 35, some other embodiments of the leg coupling mechanism are slidably coupled to the knee arm 35 so that the leg coupling mechanism can translate with respect to (and/or to rotate about) the knee arm to accommodate legs of different lengths and/or to reduce unnecessary stress on a user's leg during use of the device 10. In this regard, the leg coupling mechanism and the knee arm can slidably couple with each other in any suitable manner, including, without limitation, through the use of one or more linear bearings, linear bearing shafts, rails, sliders, drawer slides, slides, and/or other suitable mechanisms that are configured to allow the leg coupling mechanism to be slidably coupled to the knee arm. By way of non-limiting illustration, FIG. 7 shows a representative embodiment in which the leg coupling mechanism 40 slidably couples to the knee arm 35 via a slider 150 that is slidably received in elongated slots 155 of the knee arm 35. In such embodiments, the slider can comprise any suitable material, including, without limitation, nylon, polytetrafluoroethylene, polyoxymethylene, one or more bearings, and/or any other suitable material.

Figure 8:
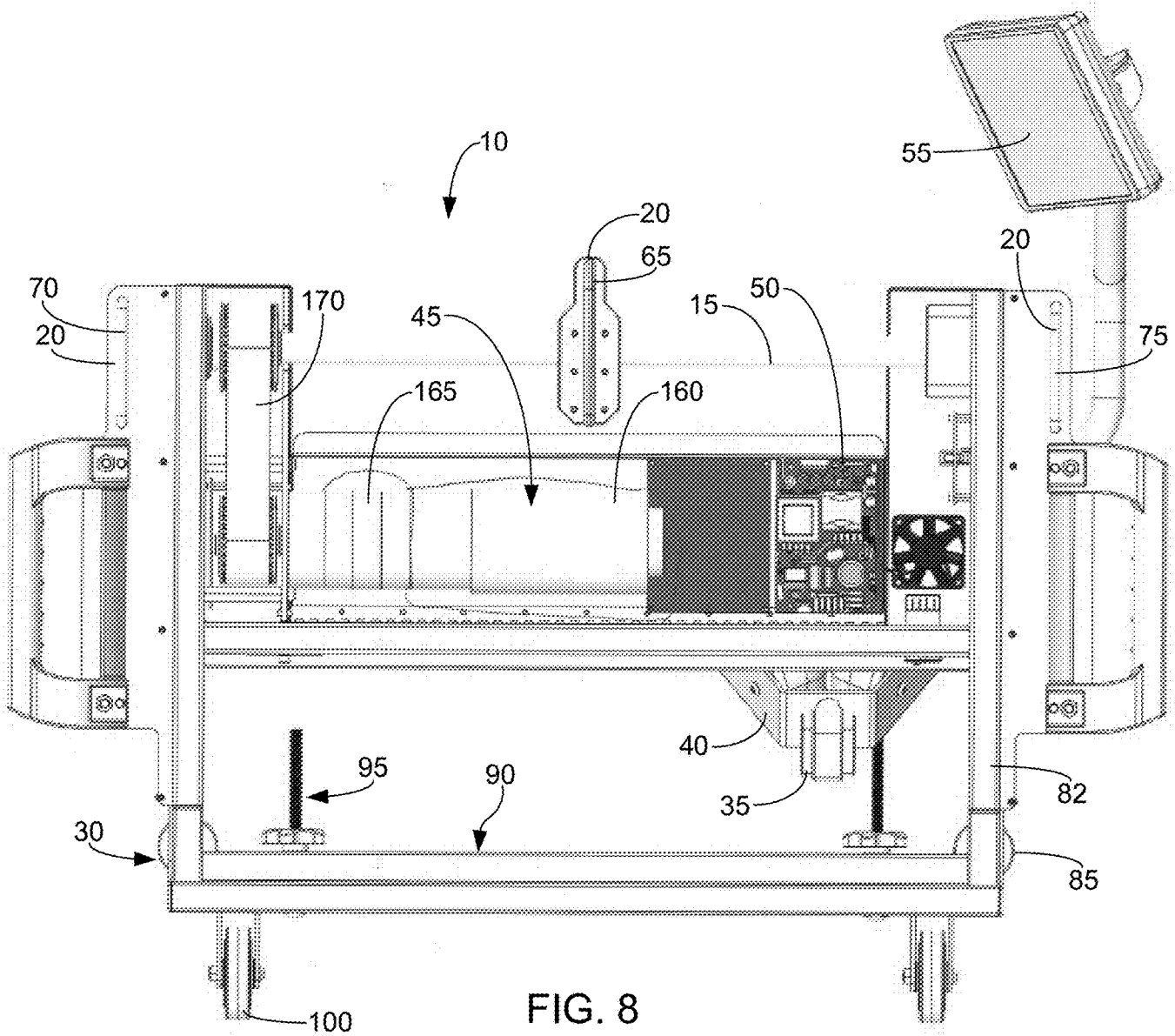
FIG. 8 illustrates a bottom plan view of the knee range of motion device, with the user support surface removed, in accordance with a representative embodiment.

With respect now to the drive mechanism 45, the drive mechanism can comprise any suitable component that is capable of forcing the knee arm 35 to move a user's leg through the knee arm's range of motion. Some examples of such components include, but are not limited to, one or more motors, actuators, pneumatic actuators, electric actuators, linear actuators, servos, positional rotation servos, continuous rotation servos, linear servos, hydraulic actuators, electric actuators, mechanical actuators, gears, belt drives, chains, chain drives, transmissions, solenoids, lever arms, pulleys, and/or any other suitable mechanical movement devices that are capable of forcing the knee arm through its range of motion. By way of illustration, FIG. 8 shows some embodiments in which the drive mechanism 45 comprises a rotary actuator 160 (e.g., a brushless electric motor and/or other suitable motor) that is coupled to a gear box 165 that, in turn, is coupled to a belt drive (e.g., a cogged belt drive and/or any other suitable belt drive, chain drive, transmission, and/or other suitable component) that couples to the rotatable shaft 105.

The drive mechanism 45 can be configured to move the rotatable shaft 105 and the knee arm 35 at any suitable speed. Indeed, in some embodiments, the drive mechanism is configured to rotate the shaft at a rate of between about 0.1 and about 18 rotations (or partial rotations) per minute or in any subrange thereof. Thus, in some embodiments, the drive mechanism is configured to rotate the shaft at a rate of 6 rotations (or six movements through a range of motion from a set extension and a set flexion point of the knee arm) per minute±3 rotation per minute. Indeed, in some embodiments, the shaft 105 is configured to rotate at between about 2.5 and about 5.5 rotations per minute. Said differently, in some embodiments, the drive mechanism is configured to move the knee arm at a rate between about 1 degree and about 90 degrees of rotation (in either direction) or any subrange thereof. Indeed, in some embodiments, the drive mechanism is configured to move the knee arm at a rate of 10.6 degrees per second±6 degrees per second.

In some embodiments, the drive mechanism's speed is adjustable (e.g., via the user interface 55 and/or in any other suitable manner). Thus, in some embodiments, a user (and/or any other suitable person, such as a therapist) can increase and/or decrease the knee arm's speed. In such embodiments, the speed can be increased and/or decreased by any suitable amount and at any suitable time. In some embodiments, the drive mechanism 45 is configured to have its speed increased and/or decreased at any suitable rate, including, without limitation, by between about 0.1% and about 300% (or any subrange thereof) of its standard rate (e.g., 6 rotations per minute±5 rotations per minute). Indeed, in some embodiments, the drive mechanism is configured to have its speed increased and/or decreased by between about 10% and about 100% (or any subrange thereof) (e.g., by about 25%, 50, 75%, etc.).

In some embodiments, the drive mechanism 45 comprises a first hard stop and/or a second hard stop that are configured to mechanically (and/or otherwise) prevent the knee arm 35 from rotating a user's knee past a specific point of extension and/or flexion (or retraction). In this regard, the drive mechanism can be mechanically (and/or otherwise) prevented from rotating the knee arm past a specific point of extension and/or flexion in any suitable manner, including, without limitation, through the use of one or more adjustable impingements, permanent impingements, mechanical switches, and/or any other suitable mechanism that is capable of limiting the knee arm's range of motion.

In one non-limiting example, the knee device 10 comprises a first and/or a second switch and the rotatable shaft (and/or any other suitable component of the device) comprises a corresponding first and/or second member, contact, stop, and/or other object or mechanism that is configured to switch the first or second switch when the shaft meets a specific position of its rotation. In another non-limiting example, the knee device comprises one or more impingements that physically prevent the knee arm (e.g., by stopping the drive mechanism 45, by overloading current on the drive mechanism, and/or in any other suitable manner) from being rotated past a desired point of extension and/or flexion. In some embodiments, the device comprises one or more movable pins, movable screws, and/or other adjustable stops that can be moved to one or more positions in which they are configured to be rotated about the shaft 105 until they contact a corresponding contact surface of the device (e.g., a hard stop) that prevents the shaft from rotating any further. Accordingly, in some such embodiments, the device can be mechanically adjusted to limit (and/or extend) the knee arm's range of motion.

Figure 9:
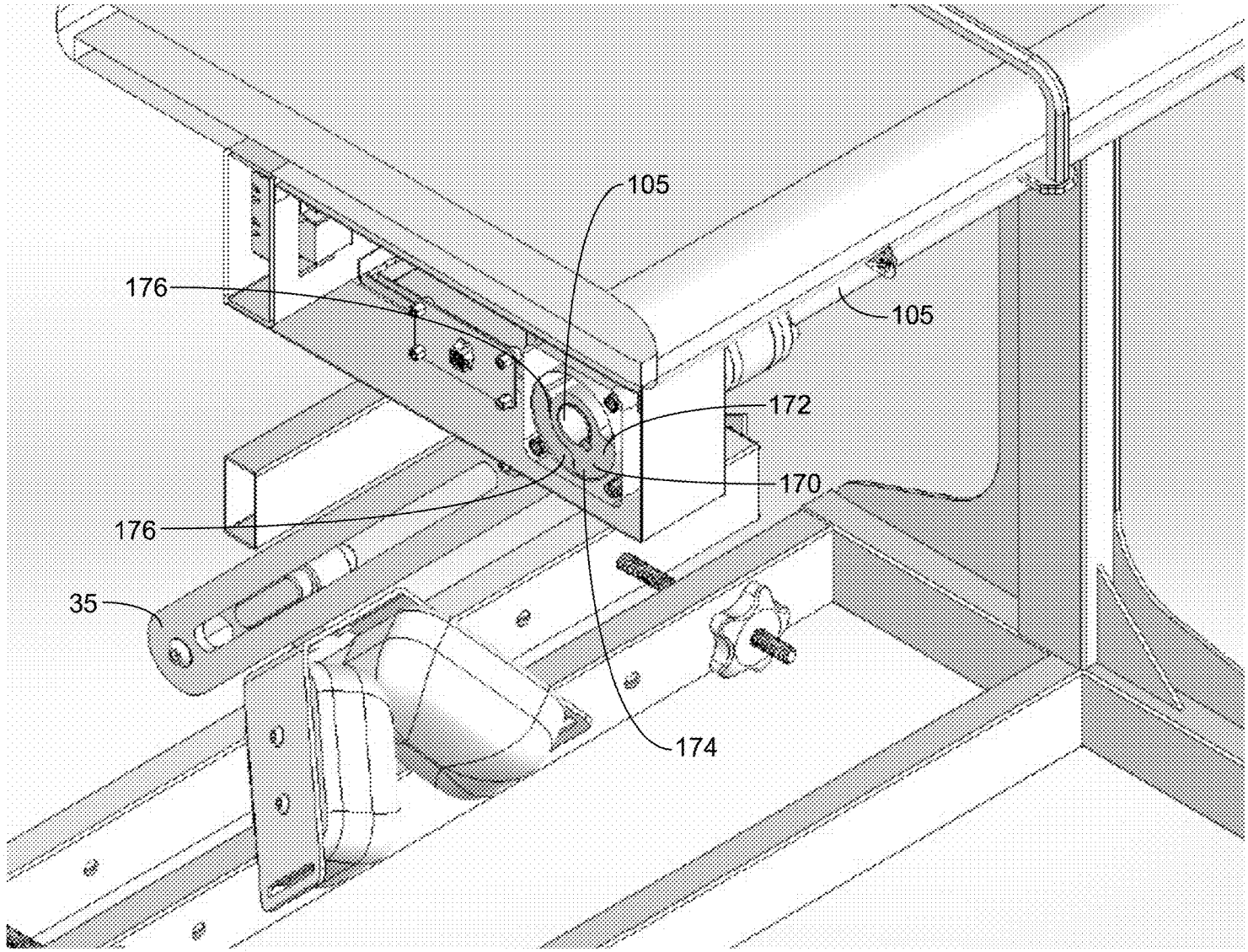
FIG. 9 illustrates a side perspective view of the knee range of motion device comprising a cam shaped device that is configured to limit the knee arm's range of motion in accordance with a representative embodiment.
Figure 10:
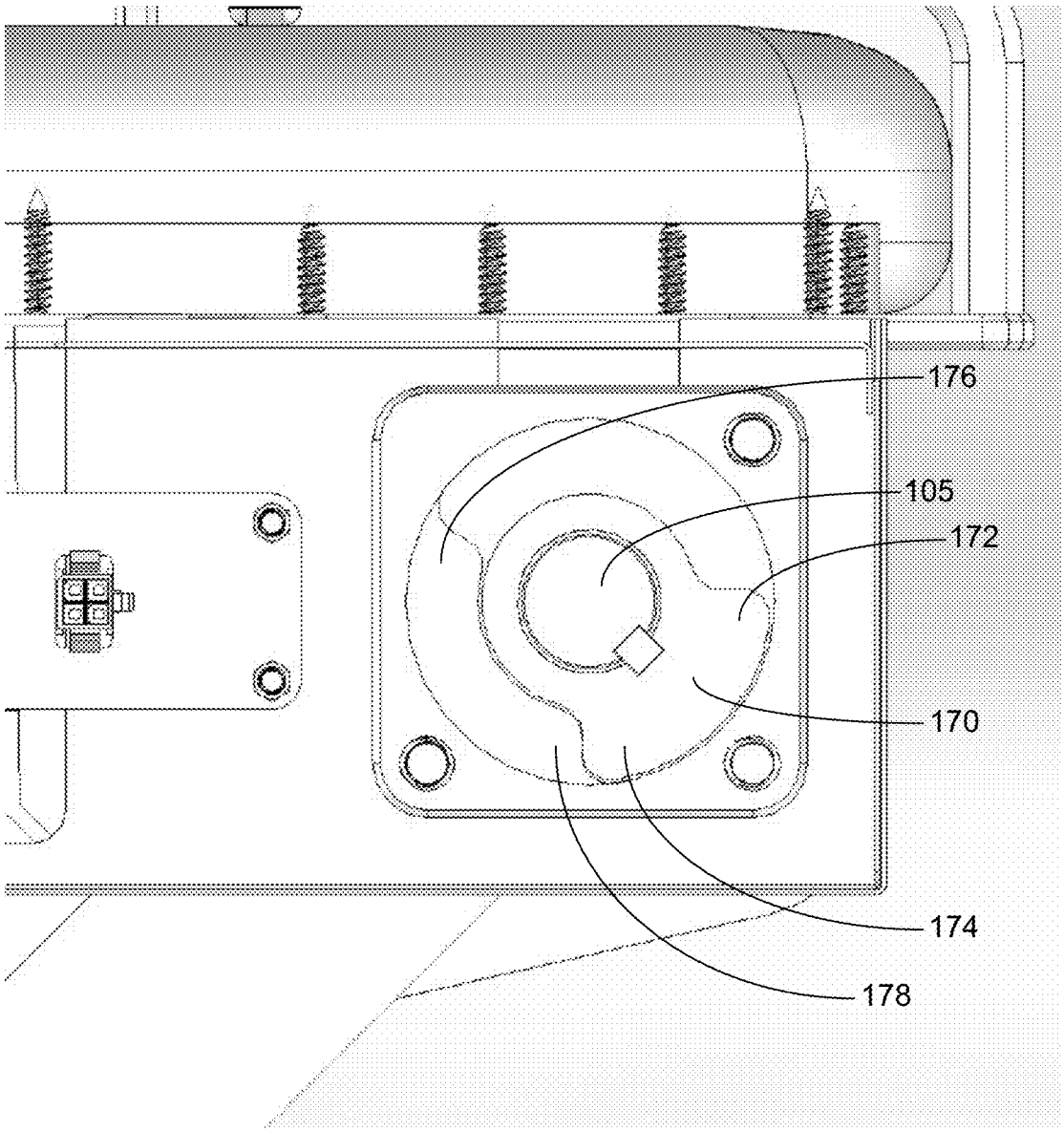
FIG. 10 illustrates a side cross-sectional view of a portion of the knee range of motion device in accordance with a representative embodiment.

In some other embodiments, the knee device 10 comprises one or more cams, pins, protrusions, members, bolts, and/or other impingements that are permanently coupled to the device (and/or that are not readily adjusted on the device) and that are configured to be moved (e.g., rotated) until they come into contact with a portion of the device (e.g., a contact surface and/or other hard stop) to prevent the knee arm 35 from being rotated past a desired point of extension and/or flexion (e.g., to prevent the device from over extending and/or flexing a user's knee). By way of non-limiting illustration, FIGS. 9 and 10 show some embodiments in which the rotatable shaft 105 comprises a cam 170 having a first 172 and second 174 shaft stopping surface, which are respectively configured to contact a first 176 and a second 178 cam stopping surface to stop rotation of the shaft.

Where the knee device 10 is comprises one or more hard stops and/or is otherwise configured to mechanically (and/or to otherwise) limit the knee arm's range of motion (e.g., as described above), the device can place any suitable limits on the knee arm 35. Indeed, in some embodiments, the device is configured to allow the knee arm to move to a maximum extension position of −20 degrees and to a maximum flexion position of 145 degrees (or in any subrange of the aforementioned range; e.g., between about −10 degrees (extension) and about 135 degrees (flexion) or any subrange thereof). Accordingly, in some embodiments, the knee arm has a range of motion of any suitable amount less than about 170 degrees of rotation (e.g., less than about 145 degrees of rotation).

Turning now to the processing system 50, the knee device 10 can comprise any suitable processing system that allows a speed of the knee arm 35 to be adjusted (e.g., increased, decreased, slowed, stopped, started, etc.); a range of motion of the knee arm to be increased, decreased, and/or maintained; a position of the knee arm to be determined; a history of the device's use to be recorded; the force of the knee arm to be determined; user feedback to be input; goals to be set; progress to be recorded; and/or that otherwise allows the device to function as described herein.

In some embodiments, the processing system 50 is configured to electrically, programmatically, and/or to otherwise limit the knee arm's range of motion (e.g., so as to move in a smaller range of motion than is set by the hard stops discussed above). In some such embodiments, a patient, therapist, a program, and/or other suitable operator can set a range of motion that is specifically tailored for the user. In one example, where a therapist determines that a user's knee joint has a very limited range of motion, the therapist can set the device to force the user's knee to move 5 degrees (and/or any other suitable amount (e.g., between about 0.1 degree and about 20 degrees, or any subrange thereof) past a comfortable flexion and/or extension of such knee. In this example, the therapist can further increase the knee arm's range of motion as the user's knee gets better and its range of motion increases. Additionally, in some embodiments, once a therapist or other practitioner sets a range of motion for a specific user, the user is not able to exceed such range of motion until the practitioner chooses to change the range.

Where the knee device 10 is able to electronically and/or programmatically control the knee arm's range of motion (e.g., via the processing system 50), the device can determine a position of the knee arm 35 in any suitable manner, including, without limitation, through the use of one or more sensors in one or more positions on the device. In this regard, the device can comprise any suitable sensors, which may include, but are not limited to, one or more position detection magnets (e.g., hall effect sensors and/or other such sensors), rotary encoders, potentiometers, proximity sensors, laser sensors, capacitive sensors, and/or any other suitable sensors that can be used to help determine a position of the knee arm.

Figure 11:
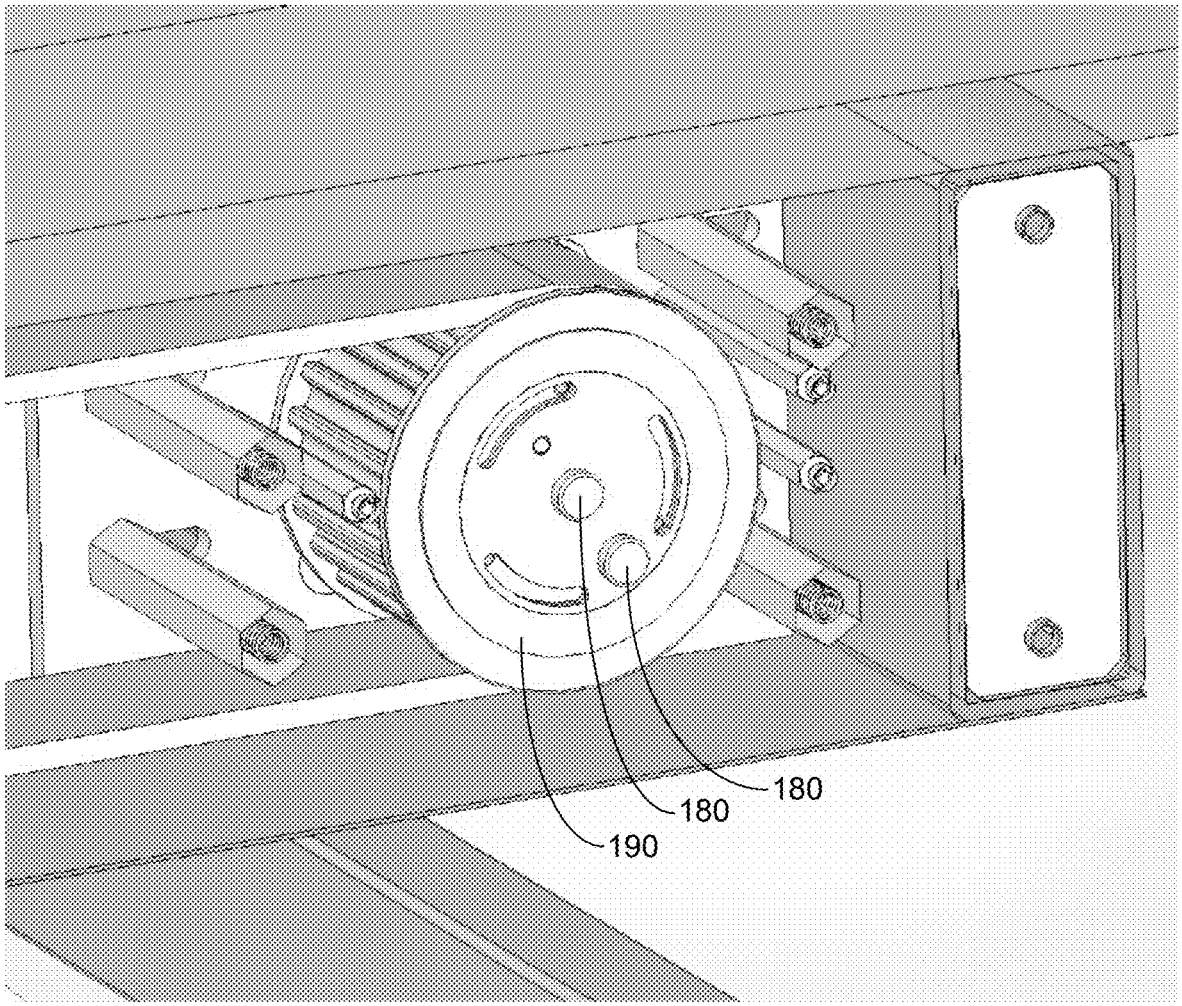
FIG. 11 illustrates a side perspective view of a portion of a drive mechanism used in the knee range of motion device in accordance with a representative embodiment.
Figure 12:
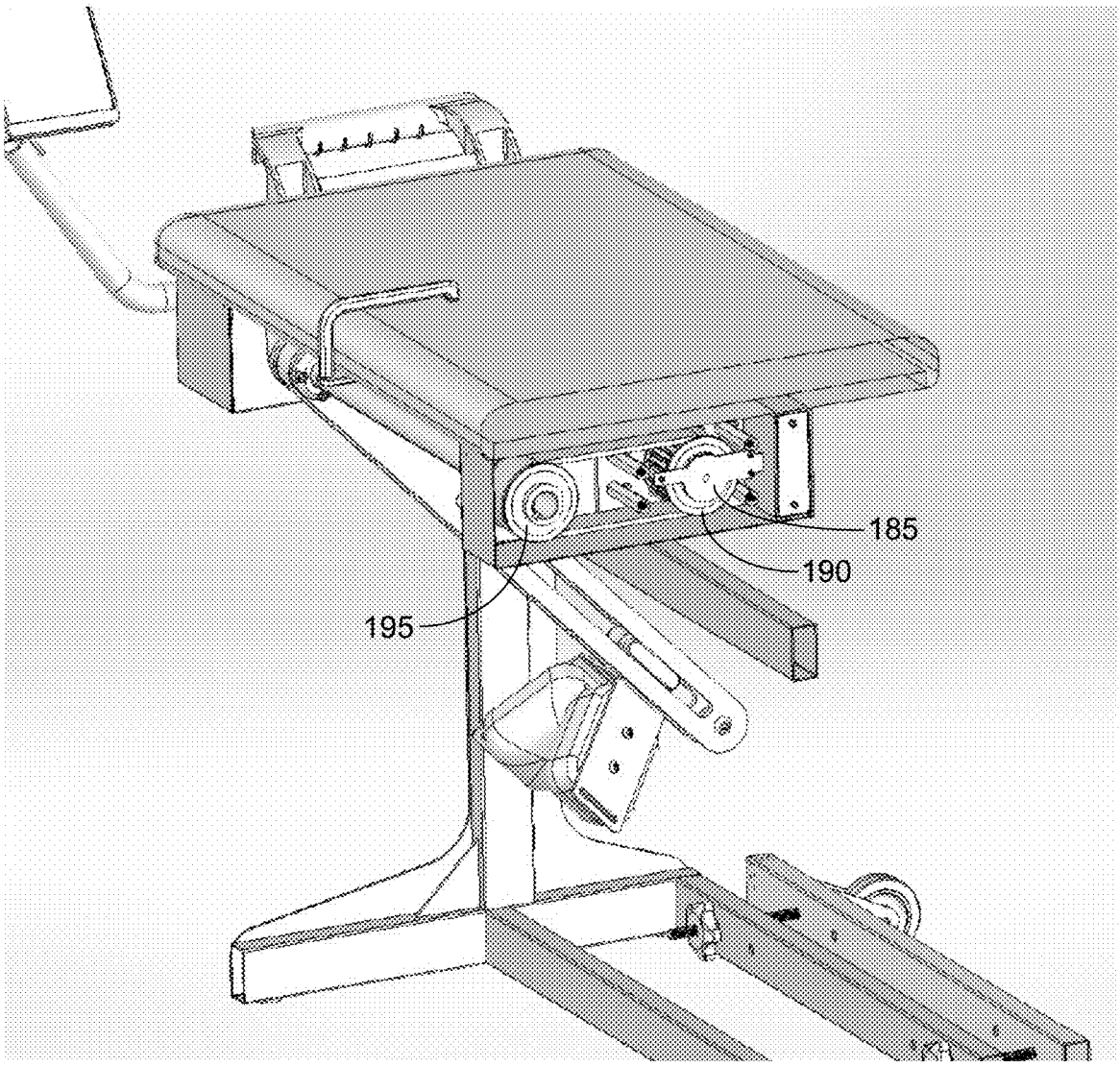
FIG. 12 illustrates a side perspective view of the knee range of motion device in accordance with a representative embodiment.
Figure 13:
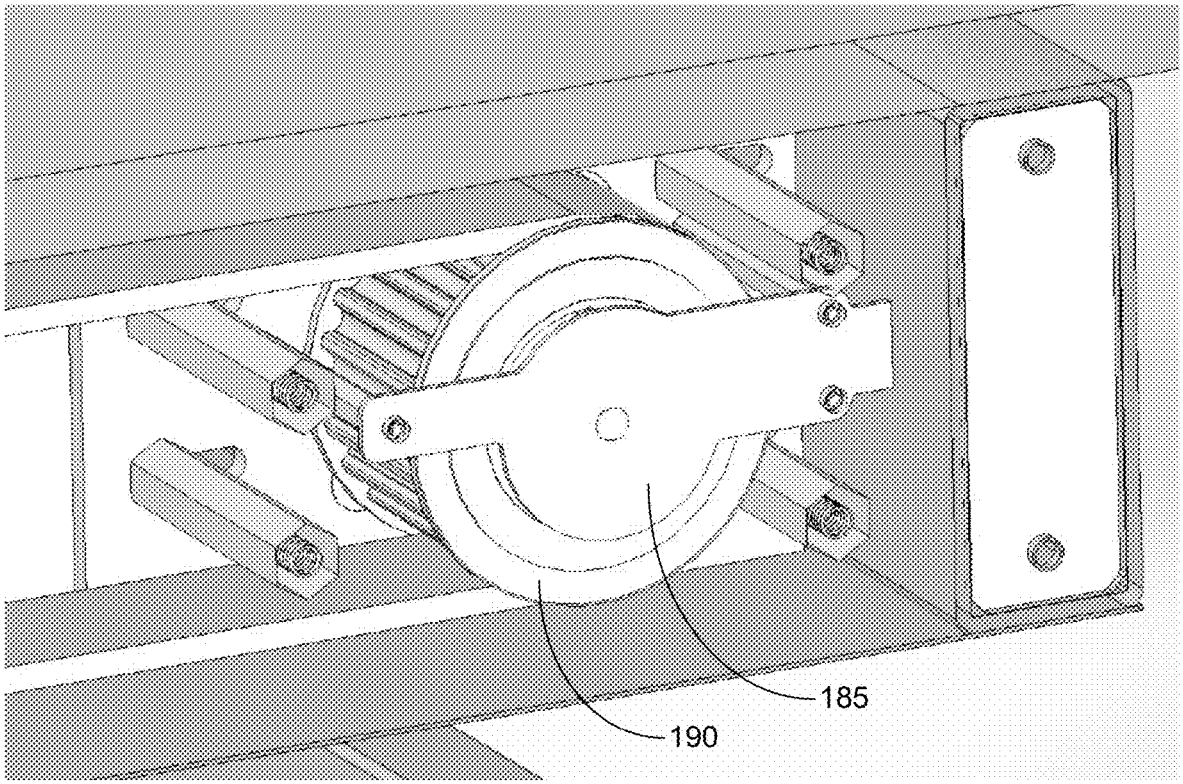
FIG. 13 illustrates a side perspective view of a portion of a drive mechanism used in the knee range of motion device in accordance with a representative embodiment.

By way of non-limiting illustration, FIGS. 11-13 show some embodiments in which the knee device 10 comprises one or more position detection magnets 180 (e.g., a center magnet and an offset magnet) and encoder circuits 185 that are configured to determine the position (e.g., the absolute and/or approximate position) of the knee arm 15. In such embodiments, the processing system can determine the position of the knee arm in any suitable manner, including, without limitation, by determining a rotational position of a first pulley, gear, and/or other component of the device and then determining the rotational position of a second pulley, gear, and/or other suitable component (e.g., based on a size ratio between the first and second component and/or in any other suitable manner). For instance, where (as shown in FIG. 12) a first pulley 190 and a second pulley 195 in the drive mechanism 45 have diameters that have a 1:1 ratio (and/or any other suitable ratio), the processing system can determine the position of the second pulley (and hence the knee arm 35) by determining the position of the first pulley (e.g., via the position detection magnets 180 and/or otherwise).

Where the knee device 10 comprises a processing system 50, the processing system can comprise any suitable component that allows it to function as described herein, including, without limitation, any suitable encoder circuit board (e.g., for determining a position of the knee arm 35 and/or any other suitable purpose), a processing unit, memory, one or more inputs and/or outputs, and/or any other suitable component, including, without limitation, one or more components described below in the section entitled Representative Operating Environment.

With reference now to the user interface 55, some embodiments of the knee device 10 comprise one or more inputs and/or outputs (as described in more detail in the section entitled Representative Operating Environment) that allow a user, a therapist, and/or any other suitable person to control the device. Indeed (and as discussed in more detail below), some embodiments of the device comprise one or more buttons, touchscreens, graphical user interfaces, dials, switches, keyboards, joysticks, kill switches, remote controls, and/or other suitable inputs and/or outputs that allow a user to control one or more functions of the device.

Figure 14:
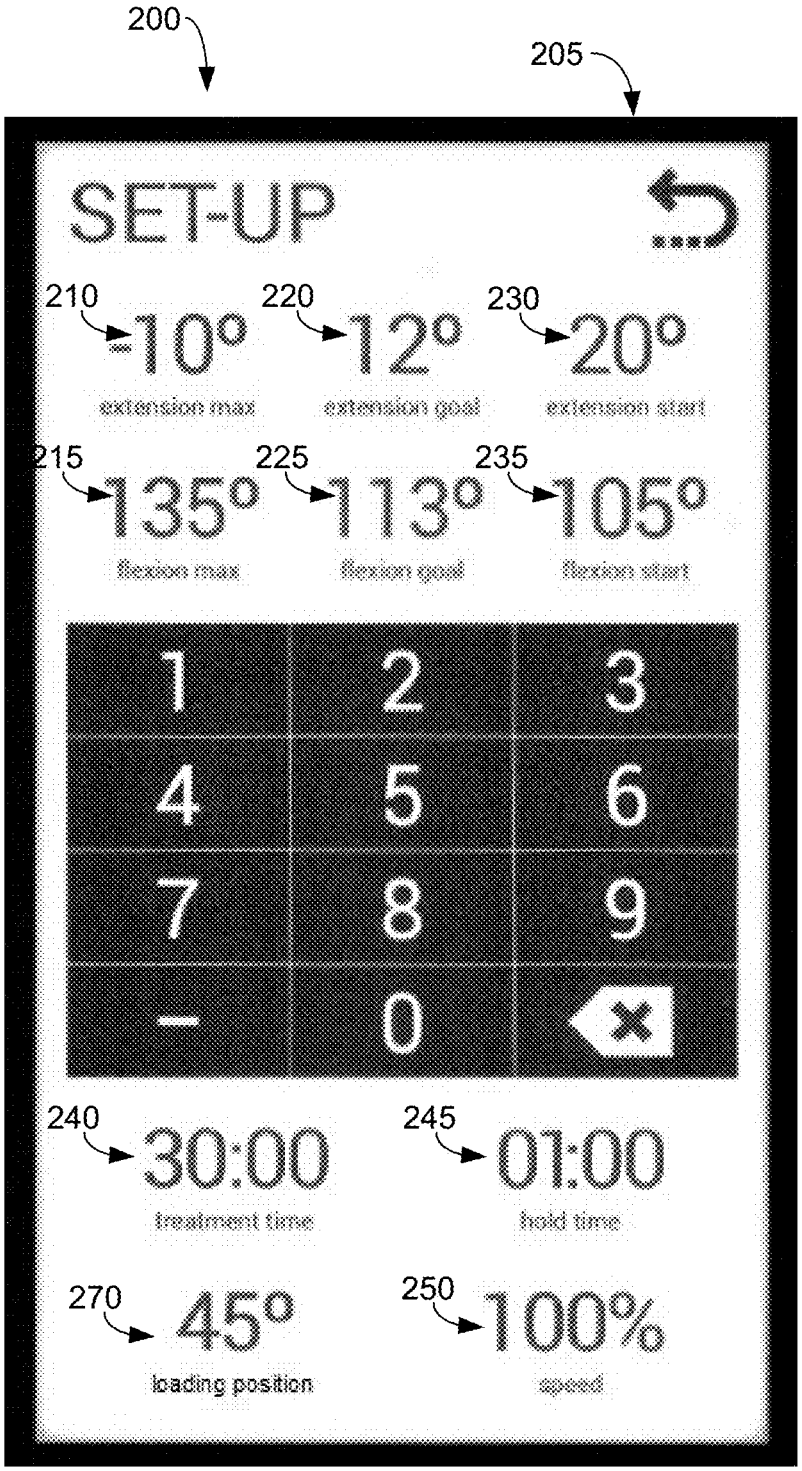
FIGS. 14-15 each illustrate a graphical user interface of the knee range of motion device in accordance with a representative embodiment.
Figure 15:
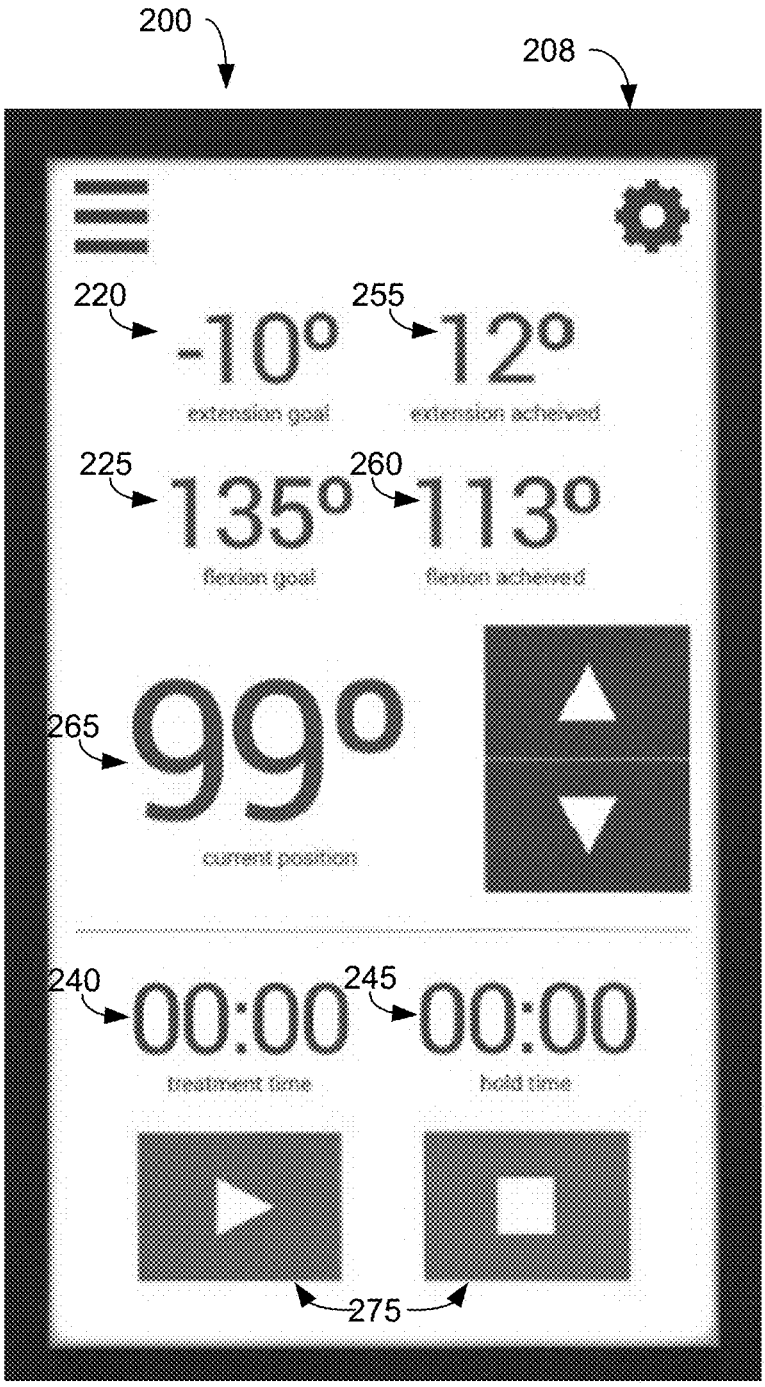

By way of non-limiting illustration, FIGS. 14-15 show that, in some embodiments, the user interface 55 comprises one or more graphical user interfaces 200 (e.g., via one or more touchscreens 205 and/or any other suitable interfaces) that display a maximum extension of the knee arm 35 210; a maximum flexion (or retraction) of the knee arm 215; an extension goal 220 (e.g., set by a therapist, a user, a program, and/or any other suitable source); a flexion goal 225; an extension start 230; a flexion start 235; a treatment (or program) time 240; a hold time 245 (e.g., a time to hold the knee arm at a set extension and/or flexion position); a set and/or actual speed of the knee arm movement 250; an extension achieved report 255; a flexion (or retraction) achieved report 260; a current position of the knee arm report 265; progress reports; graphical displays of progress; user goals; user feedback; knee arm controls (e.g., controls to move the knee arm to a loading position 270 (e.g., a position in which it is easy to couple the user's leg to the knee arm), controls to move the knee arm to a parked (or retracted) position (e.g., a position in which the knee arm is out of the way and will not trip people), controls to start and/or stop movement of the knee arm 275, controls to increase and/or decrease knee arm extension and/or flexion, controls to set and/or adjust program time, any other suitable controls and/or inputs); and/or any other suitable information and/or controls.

In some embodiments, the knee device 10 is configured to allow a user, a therapist, and/or any other suitable person or device to hold the knee arm 35 in a desired location for a desired period of time (e.g., a preset period of time) and/or to adjust the device to hold the knee arm at an initially desired extension and/or flexion point for a longer and/or a shorter period of time than the initially desired period of time. Indeed, instead of causing the device to increase and/or decrease knee arm hold time in a following cycle, some embodiments of the device (e.g., via the user interface 55 or otherwise) allow a user to increase and/or decrease knee arm hold time in real time (e.g., during a cycle, on the fly, etc.) such that a user can immediately (and/or during a cycle) increase and/or decrease the time that the knee arm is kept in a desired position. Thus, in some embodiments, when the knee arm holds a user's leg at a desired extension and/or flexion position, the user (or any other suitable person) can choose to immediately increase and/or decrease the time during which the device holds the leg in such a position.

In some embodiments, the knee device 10 is configured to allow a user, a therapist, and/or any other suitable person or device to adjust the knee arm's range of motion. Although in some embodiments, the device only implements such an adjustment in a cycle of the knee arm that follows the adjustment, in some other embodiments, the device allows a user (and/or any other suitable individual) to implement the adjustment in real time (e.g., within a cycle). In one example, when the knee arm 35 moves to a position in which it is holding a user's leg at a maximum set extension and/or flexion position, the user can adjust the knee arm (e.g., via the user interface) to further extend and/or flex the user's leg. In some such embodiments, however, the user is only able to extend the knee arm's range of motion within a range set by a practitioner for that user.

In some embodiments, the knee device 10 (e.g., via the user interface 55 or otherwise) is configured to allow a user and/or any other suitable source to set a desired loading position, parked position, to place the knee arm 35 in a neutral position (e.g., where the knee arm is manually movable, without or without resistance from the drive mechanism 45)), and/or to otherwise place the knee arm in any other suitable position. Accordingly, in some such embodiments, the device can readily be used with individuals that have a hard time moving or a limited range of leg movement.

In addition to the aforementioned components, the described knee device 10 can comprise any other suitable component or characteristic. In one example, some embodiments of the device comprise a handheld (or remote) kill switch that allows a user to immediately stop (and/or even back off) the knee arm's movement any desired time (e.g., in an emergency). In another example, some embodiments of the device comprise a handheld controller (e.g., joystick, paddle, keypad, etc.) that allows a user to easily increase and/or decrease the knee arm's hold time. In still another example, some embodiments of the device comprise a removable drive mechanism 45 cover (e.g., a hinged cover and/or any other cover that allows a portion of the drive mechanism to be accessed). In still another example, some embodiments of the device comprise one or more bushings, bearings, slides, and/or other components that allow various portions of the device (e.g., the knee arm coupler 115 and the shaft 105, the knee arm 35 and the leg coupling mechanism 40, etc.) to articulate against each other.

In yet another example, some embodiments of the knee device 10 are configured to check the resistance that is put on the knee arm 35 by a user's leg. In some such embodiments, the device determines when the resistance put on the knee arm exceeds a desired level—at which point the knee arm can stop, slow the movement of, reverse, and/or otherwise control the knee arm to prevent harm to the user. Additionally, in some such embodiments, the device is configured to use the resistance of the user's leg on the knee arm as a factor that helps the device automatically determine how far (and/or for how long) it should extend and/or retract (or flex) the user's leg.

In still another example, instead of comprising a single rotatable shaft 105 and knee arm 35, some other embodiments of the device 10 comprise two or more rotatable shafts and two or more knee arms. Accordingly, in some such embodiments, each of a user's legs can be treated at the same time, with each leg potentially receiving a different treatment (e.g., as appropriate).

In yet another example, instead of being substantially square or rectangular (e.g., as shown in FIG. 1), some embodiments of the top 80 of the user support surface 15 comprise any other suitable shape. Indeed, in some embodiments, the user support surface is substantially circular, elliptical, bicycle seat shaped, ergonomically shaped to cup and/or contour with a portion of a user's rear end and/or legs, and/or has any other suitable shape. By way of non-limiting illustration, FIG. 16 shows that in some embodiments, the user support surface is shaped to define a recess 393 that is configured to be disposed between a user's legs when a user sits on the support surface.

In still another example, the knee arm 35 can comprise any other suitable component that allows it to function as described herein. In some embodiments, the leg coupling mechanism 40 is coupled to the knee arm via one or more linear bearings, rails, linear actuators, servos, mechanisms that selectively lock the leg coupling mechanism in place with respect to the knee arm, and/or other suitable components. By way of non-limiting illustration, FIG. 16 shows that, in some embodiments, the leg coupling mechanism 40 couples with the knee arm 400 via a linear bearing or bracket slider 405 that allows the leg coupling mechanism to freely slide along a portion of the knee arm.

In even another example, instead of comprising a first anchor 65 that extends above the top 80 of the user support 80 (e.g., as shown in FIG. 1), some embodiments of the first anchor are configured to be disposed at and/or below the top 80 of the user support surface 15. By way of non-limiting illustration, FIG. 16 shows that in some embodiments, the first anchor 410 (e.g., a bar, buckle, catch, and/or any other suitable anchor point) is disposed below the top of the user support surface. In some such embodiments, such a placement can allow a user to sit on the support surface without hitting, contacting, and/or otherwise being bothered by the first anchor. Additionally, in some embodiments, by having the first anchor surface be relatively low, a strap (e.g., extending between the first anchor and the second 70 and/or third 75 anchor) can be in contact with a relatively large portion of a user's leg and may thereby capture the user's leg relatively well and in a relatively comfortable manner.

In yet another example, instead of comprising a raised bar (e.g., as shown in FIG. 1) the second 70 and or third 75 anchors can be disposed in any other suitable location (e.g., at and/or below the top 80 of the user support surface 15). By way of non-limiting illustration, FIG. 16 shows some embodiments, in which the second 420 and third 425 anchors (e.g., loops, catches, brackets, bars, etc.) are disposed below the top 80 of the user support surface 15. While such a placement can serve several suitable functions, in some cases, such placement allows a user to slide onto the support surface without striking the second and/or third anchors. Additionally, in some embodiments, by having the second and/or third anchors be disposed below the top of the user support surface, a strap (and/or other suitable component) extending between the first anchor (e.g., first anchor 410 and/or 65) and the second and/or third anchors may wrap around a relatively large portion of a user's leg, to hold such leg in a secure and comfortable fashion.

The described knee device 10 can be made in any suitable manner. In this regard, some non-limiting examples of methods for making the described device include, cutting, folding, bending, molding, shaping, extruding, connecting various pieces with one or more adhesives, mechanical fasteners (e.g., clamps, rivets, crimps, pins, brads, nails, staples, pegs, clips, threaded attachments, couplers, etc.), welding pieces together, connecting pieces together, and/or any other suitable method that allows the described knee device to perform its intended functions.

In addition to the aforementioned features, the described knee device 10 can comprise any other suitable characteristic that allows it to function as described herein. Indeed, in accordance with some embodiments in which the device comprises one or more hard stops, the device is configured move the knee arm in a maximum range of motion that is acceptable for healthy users. Accordingly, in some such embodiments, the device is configured to be safe to use and to prevent a user from being injured by over extension and/or flexion.

Additionally, in some embodiments in which the device is configured to determine a position of the knee arm, the device is configured to programmatically limit the knee arm's range of motion. In some such embodiments, one user may be prevented from extending and/or retracting the knee arm any further than has been set programmatically for that user (e.g., by a therapist).

In some other embodiments in which the knee device 10 comprises a remote stop (or kill switch), a user can immediate stop the knee arm's motion at any desired time. Accordingly, some such embodiments provide the user with multiple safety features to prevent injury to the user.

In some other embodiments in which the knee device 10 comprises (or is connectable to) a table or bench, a user is able to lie down and to effectively stretch hip flexors, quadriceps, and/or any other suitable portion of the user's body.

Representative Operating Environment

The described knee device 10 and its accompanying systems and methods can be used with any suitable operating environment and/or software. In this regard, FIG. 17 and the corresponding discussion are intended to provide a general description of a suitable operating environment in accordance with some embodiments of the described systems and methods. As will be further discussed below, some embodiments embrace the use of one or more processing units in a variety of customizable enterprise configurations, including in a networked or combination configuration, which may also include a cloud-based service, such as a platform as a service, software as a service, and/or as any other suitable service.

Some embodiments of the described systems and methods embrace one or more computer readable media, wherein each medium may be configured to include or includes thereon data (non-transitory or transitory) or computer executable instructions for manipulating data. The computer executable instructions include data structures, objects, programs, routines, and/or other program modules that may be accessed by one or more processors, such as one associated with a general-purpose modular processing unit capable of performing various different functions and/or one associated with a special-purpose processing unit capable of performing a limited number of, and/or specific, functions (e.g., a special-purpose processing unit for controlling the device 10).

Computer executable instructions cause the one or more processors of the one or more enterprises to perform a particular function or group of functions and are examples of program code means for implementing steps for methods of processing. Furthermore, a particular sequence of the executable instructions provides an example of corresponding acts that may be used to implement such steps.

Examples of computer readable media (including, without limitation, non-transitory computer readable media) include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), any solid state storage device (e.g., flash memory, smart media, etc.), and/or any other device or component that is capable of providing data and/or executable instructions that may be accessed by a processing unit.

Figure 17:
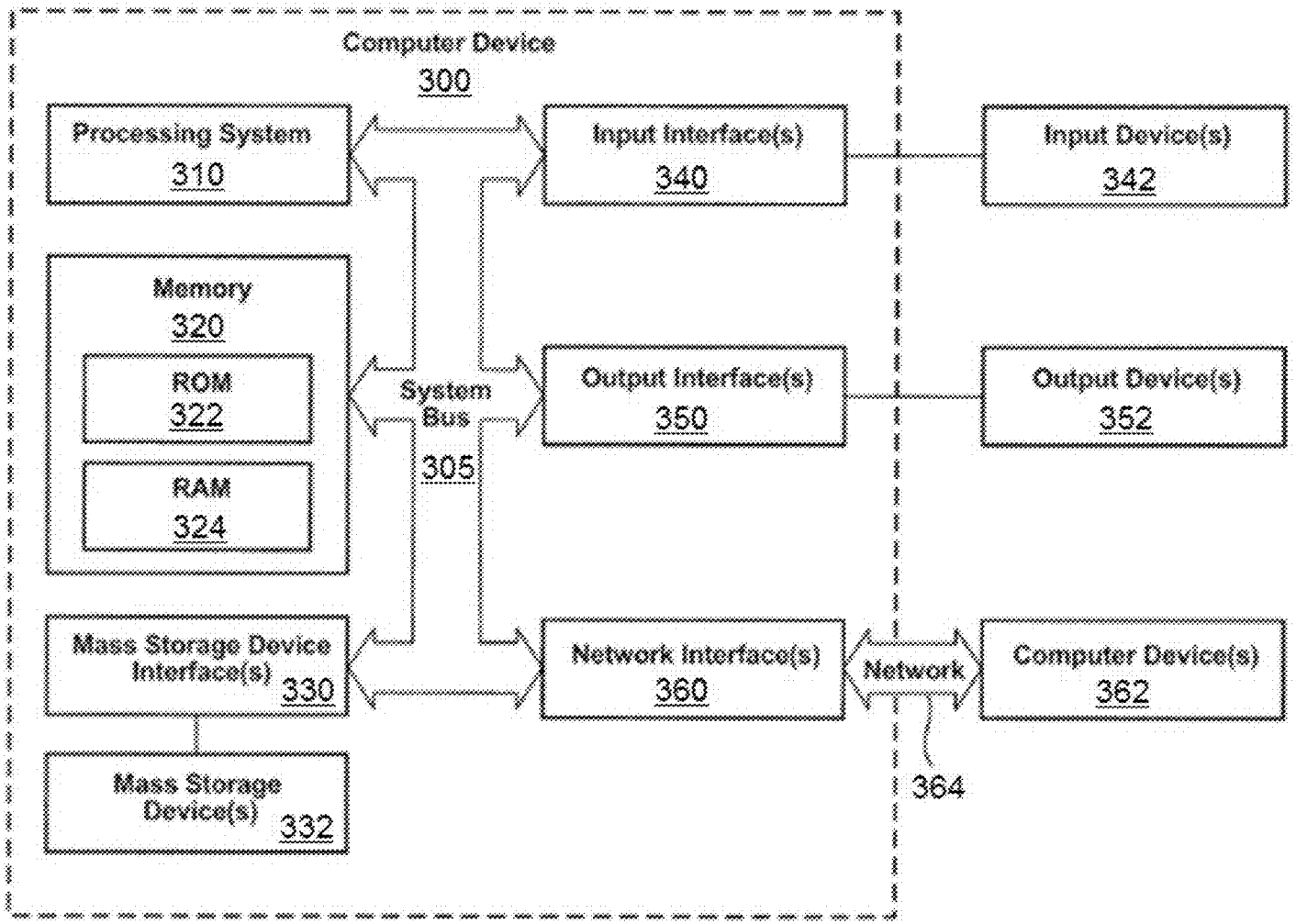
FIG. 17 illustrates a representative system that provides a suitable operating environment for use with some embodiments of the knee range of motion device.

With reference to FIG. 17, a representative enterprise includes modular processing unit 300 (e.g., a computer system, a wireless computer device, and/or other computer device), which may be used as a general-purpose or a special-purpose processing unit. For example, modular processing unit (or computer device) 300 may be employed alone or with one or more similar processing units as computer, a display 55, a smart phone, a cellular phone, a feature phone, a tablet computer, a smart television, a mobile computer device, a personal computer, a notebook computer, a PDA or other hand-held device, a workstation, a mini-computer, a mainframe, a supercomputer, a multi-processor system, a network computer, a processor-based consumer device, a smart appliance or device, a control system, and/or the like. Indeed, in some embodiments, the processing unit comprises at least one of a server and a computer device (including, without limitation, a wireless computer device). Using multiple processing units in the same enterprise provides increased processing capabilities. For example, each processing unit of an enterprise can be dedicated to a particular task or can jointly participate in distributed processing.

In FIG. 17, the processing unit 300 (e.g., a computer system and/or computer device) includes one or more buses and/or interconnects 305, which may be configured to connect various components thereof and enables data to be exchanged between two or more components. The bus(es)/interconnect(s) 305 may include one of a variety of bus structures, including, without limitation, a memory bus, a peripheral bus, and/or a local bus that uses any of a variety of bus architectures. Typical components connected by the bus(es)/interconnect(s) 305 include one or more processors 310 and one or more memories 320. Some other non-limiting components that may be selectively connected to the bus(es)/interconnect(s) 305 through the use of logic, one or more systems, and one or more subsystems, include one or more mass storage device interfaces 330, input interfaces 340, output interfaces 350, and/or network interfaces 360, each of which will be discussed below.

In some embodiments, the processing system 310 includes one or more processors, such as a central processor, a microprocessor, and optionally one or more other processors designed to perform a particular function or task. It is typically the processing system 310 (also referred to as a processor or computer processor) that executes the instructions provided on computer readable media, such as on the memory 320, a magnetic hard disk, a removable magnetic disk, a magnetic cassette, an optical disk, and/or from a communication connection, which may also be viewed as a computer readable medium.

In accordance with some embodiments, the memory 320 includes one or more computer readable media (including, without limitation, non-transitory computer readable media) that may be configured to include or includes thereon data or instructions for manipulating data, and may be accessed by the processing system 310 through the system bus 305. The memory 320 may include, for example, ROM 322 used to permanently store information, and/or RAM 324 used to temporarily store information. In some embodiments, ROM 322 includes a basic input/output system ("BIOS") having one or more routines that are used to establish communication, such as during start-up of computer device 300. In some embodiments, RAM 324 includes one or more program modules, such as one or more operating systems, application programs, and/or program data.

One or more mass storage device interfaces 330 may be used to connect one or more mass storage devices 332 to the system bus 305. The mass storage devices 332 may be incorporated into and/or may be peripheral to the computer device 300 and allow the computer device (and/or computer system) 300 to retain large amounts of data. Optionally, one or more of the mass storage devices 332 may be removable from computer device 300. Examples of mass storage devices include hard disk drives, magnetic disk drives, tape drives, solid state mass storage, and/or optical disk drives.

Some non-limiting examples of solid state mass storage include flash cards and memory sticks. The mass storage device 332 may read from and/or write to a magnetic hard disk, a removable magnetic disk, a magnetic cassette, an optical disk, or another computer readable medium. The mass storage devices 332 and their corresponding computer readable media provide nonvolatile storage of data and/or executable instructions that may include one or more program modules, such as an operating system, one or more application programs (or applications), other program modules, or program data. Such executable instructions are examples of program code means for implementing steps for methods disclosed herein.

One or more input interfaces 340 may be employed to enable a user to enter data (e.g., initial information) and/or instructions to computer device (or computer system) 300 through one or more corresponding input devices 342. Examples of such input devices include one or more remote stop controllers, kill switches, joysticks, keypads, buttons, controls, keyboard and/or alternate input devices, digital cameras, camcorders, sensors, scanners, readers, writing capture devices, touch screens, mice, trackballs, light pens, styluses or other pointing devices, microphones, game pads, remote controls, scales, and/or other input devices. Similarly, examples of input interfaces 340 that may be used to connect the input devices 342 to the system bus 305 include a serial port, a parallel port, a game port, a universal serial bus ("USB"), a firewire (IEEE 1394), a wireless receiver, a video adapter, an audio adapter, a parallel port, a wireless transmitter, and/or another interface.

One or more output interfaces 350 may be employed to connect one or more corresponding output devices 352 to the system bus 305. Examples of output devices include one or more monitors, projectors, display screens, speakers, lights, wireless transmitters, printers, and the like. A particular output device 352 may be integrated with or peripheral to computer device 300. Examples of output interfaces include a video adapter, an audio adapter, a parallel port, and the like.

One or more network interfaces 360 enable computer device (or computer system) 300 to exchange information with one or more local or remote computer devices, illustrated as computer devices 362, via a network 364 that may include one or more hardwired and/or wireless links. Examples of the network interfaces include a network adapter for connection to a local area network ("LAN") or a modem, a wireless link, an infrared link, a BLUETOOTH® link, and/or another adapter for connection to a wide area network ("WAN"), such as the Internet. The network interface 360 may be incorporated with or be peripheral to computer device 300.

Figure 18:
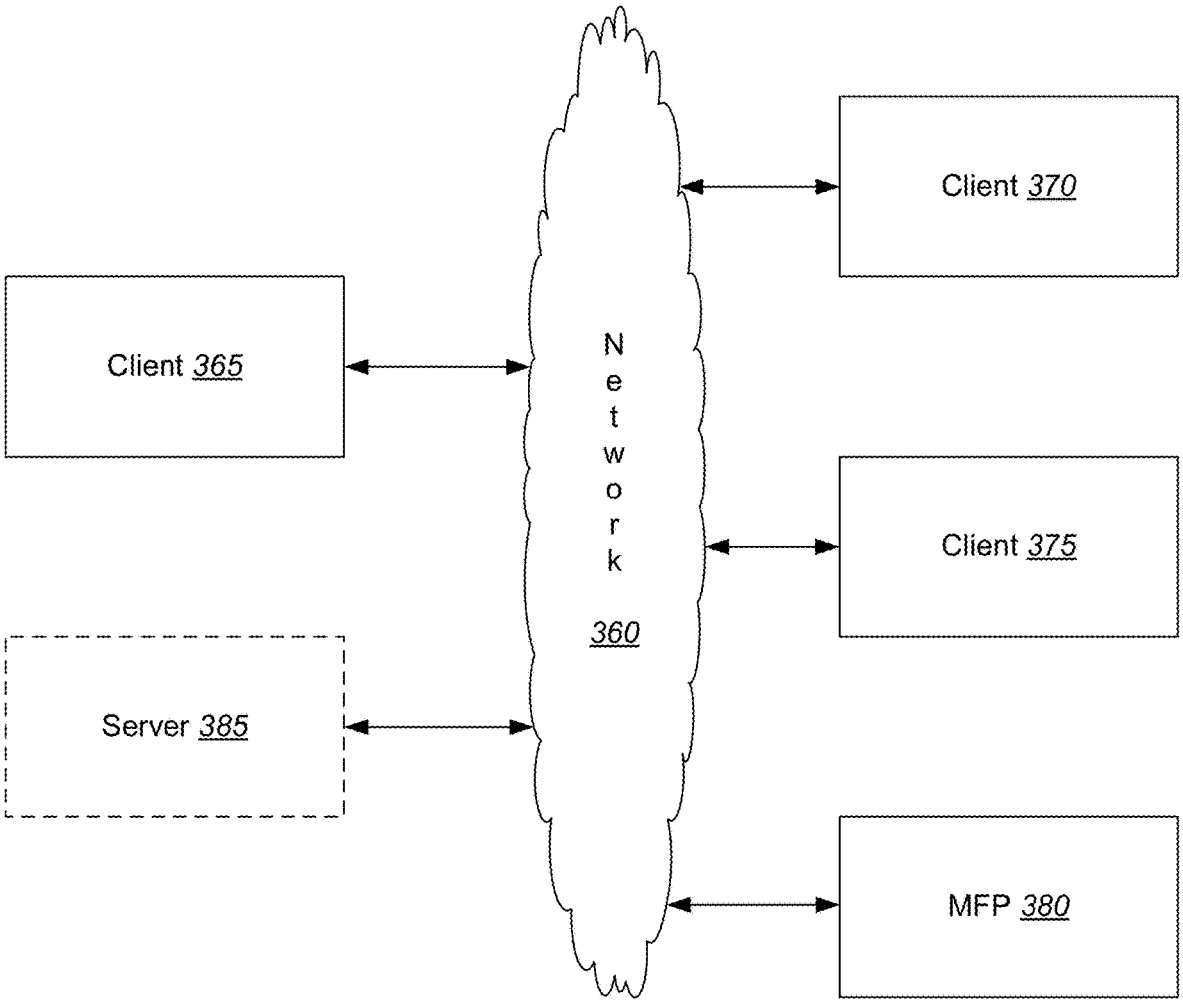
FIG. 18 illustrates a representative networked environment for use with some embodiments of the described knee device.

In a networked system, accessible program modules or portions or information thereof may be stored in a remote memory storage device. Furthermore, in a networked system computer device 300 may participate in a distributed computing environment, where functions or tasks are performed by a plurality networked computer devices. While those skilled in the art will appreciate that the described systems and methods may be practiced in networked computing environments with many types of computer system configurations, FIG. 18 represents an embodiment of a portion of the described systems in a networked environment that includes clients (or computer devices 365, 370, 375, etc.) or client knee devices 10 and/or and one or more peripheral devices (illustrated as multifunctional peripheral (MFP) MFP 380) connected to a server 385 via a network 360. While FIG. 18 illustrates an embodiment that includes three clients (e.g., knee devices) controlled over or otherwise connected to the network (and one or more servers 385), alternative embodiments include at least one client (e.g., knee device) connected to a network or many (e.g., 2, 4, 5, 6, 7, 8, and or any other suitable number of) clients (e.g., knee devices) connected to a network and/or one or more servers.

Thus, as discussed herein, the present invention relates to systems and methods for providing a knee range of motion device. In some implementations, the described device includes a knee arm that is configured to pivot through a range of motion and a drive mechanism that is configured to force the knee arm through the range of motion. In some cases, the drive mechanism includes a first hard stop that prevents the knee arm from extending past a first set point, and the drive mechanism further includes a second hard stop that prevents the knee arm from being retracted past a second set point. In some cases, the device is further configured to be programmed to electronically limit the knee arm's range of motion. In some cases, the device further comprises a remote stop that is configured to allow a user to immediately stop the knee arm from moving through the range of motion.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A knee rehabilitation device comprising: a sitting surface configured to support an individual; a knee arm that is pivotally coupled to the rehabilitation device, wherein the knee arm couples to and is rotationally enslaved with an elongated shaft, wherein the knee arm is configured to be selectively moved to multiple locations along a length of the elongated shaft, the knee arm comprising a leg coupling mechanism that is configured to couple a leg of the individual to the knee arm such that as the knee arm is pivoted through a range of motion and about a pivot point, the knee arm causes a knee of the individual's leg to at least one of (i) flex and (ii) extend; and a drive mechanism that is configured to force the knee arm through the range of motion, wherein the pivot point about which the knee arm pivots is disposed below the sitting surface during use.

2. The device of claim 1, wherein the sitting surface comprises a front end and a back end, wherein the knee arm is disposed adjacent to the front end of the sitting surface, and wherein the pivot point is disposed behind the front end of the sitting surface.

3. The device of claim 1, wherein the leg coupling mechanism is configured to couple a right leg and a left leg of the individual to the knee arm so that as the knee arm pivots through the range of motion, the knee arm and the leg coupling mechanism are configured to simultaneously move the left leg and right leg together.

4. The device of claim 1, wherein the pivot point is disposed behind a front end of the sitting surface.

5. The device of claim 1, wherein the sitting surface comprises a front end, a back end, a right side, and a left side, wherein the pivot point is disposed adjacent to the front end, wherein the device comprises a first handle that is disposed at the right side, closer to the back end than to the front end, and wherein the device further comprises a second handle that is disposed at the left side, closer to the back end than to the front end.

6. The device of claim 1, wherein the leg coupling mechanism is slidably coupled to the knee arm such that when the knee arm pivots through the range of motion, the leg coupling mechanism is configured to translate along a length of the knee arm, while still being fixedly coupled to the knee arm.

7. The device of claim 6, wherein the leg coupling mechanism is configured to couple a right leg and a left leg of the individual to the knee arm so that as the knee arm moves through the range of motion, the knee arm and the leg coupling mechanism are configured to simultaneously move the left leg and right leg together.

8. A knee rehabilitation device comprising: a sitting surface configured to support an individual; a knee arm that is pivotally coupled to the rehabilitation device so as to move through a range of motion as the knee arm pivots about a pivot point, wherein the knee arm couples to and is rotationally enslaved with an elongated shaft disposed below the sitting surface, wherein a knee arm coupler slidingly couples the knee arm to the elongated shaft so that the knee arm is configured to be selectively moved between multiple locations along a length of the elongated shaft, the knee arm comprising a leg coupling mechanism that is slidingly coupled to the knee arm and that is configured to couple a leg of the individual to the knee arm such that when the knee arm moves through the range of motion, the leg coupling mechanism is able to translate along a length of the knee arm, while still being fixedly coupled to the knee arm; and a drive mechanism that is configured to force the knee arm through the range of motion.

9. The device of claim 8, further comprising a first anchor, a second anchor, and a third anchor, with at least the first anchor being disposed adjacent to the sitting surface, and with the first anchor being disposed between the second anchor and the third anchor, wherein the rehabilitation device further comprises a first strap that is coupled to the first anchor and that is configured to be selectively coupled to at least one of the second anchor and the third anchor.

10. The device of claim 8, wherein the leg coupling mechanism is configured to couple to both legs of the individual to force both of legs of the individual to move together as the knee arm moves through the range of motion.

11. The device of claim 6, wherein the elongated shaft comprises a cam-shaped object having a first shaft stopping surface and a second shaft stopping surface that are configured to respectively contact a first cam stopping surface and a second cam stopping surface to prevent over rotation of the knee arm.

12. A knee rehabilitation device comprising: a sitting surface configured to support an individual; a rotating shaft that is configured to rotate in a range of motion between a first stopping point and a second stopping point, and vice versa, wherein the rotating shaft comprises an elongated member; a knee arm that is rotationally enslaved to a rotation of the rotating shaft such that the knee arm is configured to pivot around a rotational axis of the rotating shaft and through the range of motion as the rotating shaft rotates, wherein the knee arm comprises a leg coupling mechanism, wherein a knee arm coupler slidingly couples the knee arm to the rotating shaft so as to enslave rotation of the knee arm to the rotating shaft and to allow the knee arm to be selectively moved between multiple locations along a length of the elongated member; and a drive mechanism that is configured to force the rotating shaft and the knee arm through the range of motion, wherein the rotating shaft is disposed below the sitting surface.

13. The device of claim 12, further comprising an adjustment mechanism that is configured to selectively raise and lower the sitting surface, in its entirety.

14. The device of claim 12, wherein the device comprises a support structure that supports the sitting surface and the knee arm, and wherein the device further comprises a coupling mechanism that is configured to couple the rehabilitation device to at least one of a chair, a table, a bed, and another patient support device.

15. The device of claim 12, wherein the pivot point is disposed behind a front end of the sitting surface by a distance that is substantially equal to a distance between a longitudinal axis of the knee arm and a portion of the leg coupling mechanism that is configured to hold a rearmost portion of the leg of the individual that is coupled to the knee arm at the leg coupling mechanism.

* * * * *